US011926943B2

(12) United States Patent
Takei et al.

(10) Patent No.: US 11,926,943 B2
(45) Date of Patent: Mar. 12, 2024

(54) CLOTH MOVEMENT DETECTION DEVICE AND SEWING MACHINE

(71) Applicant: JANOME Corporation, Hachioji (JP)

(72) Inventors: Tatsuo Takei, Hachioji (JP); Ayuko Hayasaka, Hachioji (JP); Kentaro Akahane, Hachioji (JP)

(73) Assignee: JANOME Corporation, Hachioji (JP)

( * ) Notice: Subject to any disclaimer, the term of this patent is extended or adjusted under 35 U.S.C. 154(b) by 78 days.

(21) Appl. No.: 17/880,664

(22) Filed: Aug. 4, 2022

(65) Prior Publication Data

US 2023/0064230 A1 Mar. 2, 2023

(30) Foreign Application Priority Data

Aug. 31, 2021 (JP) ..... 2021-142036

(51) Int. Cl.
*D05B 19/14* (2006.01)
*D05B 69/00* (2006.01)
*D05B 79/00* (2006.01)

(52) U.S. Cl.
CPC ..... *D05B 19/14* (2013.01); *D05B 69/00* (2013.01); *D05B 79/00* (2013.01)

(58) Field of Classification Search
CPC ..... D05B 19/14; D05B 29/06; D05B 19/12; D05B 19/16
USPC ..... 112/475.02, 272, 470.03
See application file for complete search history.

(56) References Cited

U.S. PATENT DOCUMENTS 4,342,273 A * 8/1982 Petzold ..... G01B 11/028 112/272
4,423,691 A * 1/1984 Schwaab ..... D05B 69/24 112/272
4,548,143 A * 10/1985 Martell ..... D05B 69/20 112/470.03
4,658,741 A * 4/1987 Jehle ..... D06H 1/02 112/272
4,784,071 A * 11/1988 Sadeh ..... D05B 35/102 112/470.07
4,848,256 A * 7/1989 Ohchi ..... D05B 35/102 112/272

(Continued)

FOREIGN PATENT DOCUMENTS

JP 4724938 B 7/2011

*Primary Examiner* — Danny Worrell
(74) *Attorney, Agent, or Firm* — Yokoi & Co., U.S.A.; Toshiyuki Yokoi

(57) ABSTRACT

Provided with a cloth movement detection device and a sewing machine capable of precisely detecting a movement of a cloth. A cloth movement detection device includes: a light detection portion configured to detect a light for detecting a movement of a cloth; a body portion configured to be detachably attached to a presser bar of a sewing machine, the light detection portion being installed in the body portion; and a pressing support portion configured to be detachably attached to the body portion, a cloth pressing portion capable of contacting with the cloth being formed on the pressing support portion, wherein a window portion capable of transmitting the light is provided on a bottom surface of the body portion, and the cloth pressing portion is located lower than the bottom surface of the body portion in a state that the pressing support portion is attached to the body portion.

11 Claims, 23 Drawing Sheets

(56) References Cited

U.S. PATENT DOCUMENTS

| | | | | |
|---|---|---|---|---|
| 5,271,345 | A * | 12/1993 | Matschulat | D05B 35/102<br>112/470.07 |
| 6,883,446 | B2 | 4/2005 | Koerner | |
| 7,325,502 | B2 * | 2/2008 | Konig | D05B 19/14<br>112/272 |
| 8,186,290 | B2 * | 5/2012 | Makino | D05B 19/16<br>112/470.13 |
| 11,015,276 | B2 * | 5/2021 | Konzak | D05B 11/00 |
| 2006/0213415 | A1 * | 9/2006 | Konig | D05B 19/14<br>112/475.01 |

* cited by examiner

CLOTH MOVEMENT DETECTION DEVICE AND SEWING MACHINE

CROSS-REFERENCES TO RELATED APPLICATIONS

This patent specification is based on Japanese patent application, No. 2021-142036 filed on Aug. 31, 2021 in the Japan Patent Office, the entire contents of which are incorporated by reference herein.

BACKGROUND OF THE INVENTION

1. Field of the Invention

The present invention relates to a cloth movement detection device and a sewing machine.

2. Description of the Related Art

In a sewing operation of a sewing machine, seams are formed on a cloth by moving a needle in a vertical direction while feeding the cloth. Normally, a feeding mechanism of the cloth is provided on the sewing machine and the cloth is automatically fed. On the other hand, the seams can be formed by feeding the cloth by hand in a free direction without using the feeding mechanism, for example when forming a quilting.

When the seams are formed by feeding the cloth by hand, the cloth should be fed at a constant speed in accordance with the operation speed of the needle in the vertical direction for forming the seams at a predetermined sewn pitch. In a quilting formed by overlapping cloths and stuffing cotton between the cloths, it is difficult to feed the cloths and it takes a lot of time to master the operation for forming the seams at a predetermined sewn pitch.

As shown in Patent documents 1 to 3, there is a technology for detecting a movement of the cloth and changing a rotation speed of a motor in accordance with a detection result to adjust an operation speed of the needle. Consequently, even when a moving speed of the cloth fed by hand is not constant, the operation speed of the needle is adjusted. Thus, it becomes relatively easier to form the seams at a predetermined sewn pitch.

[Patent document 1] Japanese Patent No. 4724938
[Patent document 2] U.S. Pat. No. 6,883,446
[Patent document 3] U.S. Pat. No. 7,325,502

BRIEF SUMMARY OF THE INVENTION

In the above described configuration, a light detection portion (sensor) for detecting the movement of the cloth is arranged near a sewing machine needle. The light detection portion is, for example, an image sensor (imaging element) for detecting the light reflected on the cloth.

When the light detection portion is provided at the position nearly in contact with the cloth, a detectable range of the light detection portion becomes narrower compared to the case where the light detection portion is separated from the cloth. The inventors of the present invention obtained the knowledge that the movement of the cloth could not be detected in some kinds of cloths and patterns. In such a case, the light detection portion erroneously determines that the moving amount of the cloth is zero. As a result, the movement of the needle is delayed or stopped despite that the cloth is moved by hand. Thus, the problem is that the seams cannot be formed at a predetermined sewn pitch desired by the operator.

The present invention provides a cloth movement detection device and a sewing machine capable of precisely detecting the movement of the cloth.

For solving the above described problems, the cloth movement detection device and the sewing machine of the present invention adopt the following means.

Namely, the cloth movement detection device of the present invention includes: a light detection portion configured to detect a light for detecting a movement of a cloth; a body portion configured to be detachably attached to a presser bar of a sewing machine, the light detection portion being installed in the body portion; and a pressing support portion configured to be detachably attached to the body portion, a cloth pressing portion capable of contacting with the cloth being formed on the pressing support portion, wherein a window portion capable of transmitting the light is provided on a bottom surface of the body portion, and the cloth pressing portion is located lower than the bottom surface of the body portion in a state that the pressing support portion is attached to the body portion.

In the above described configuration, the light is detected by the light detection portion and the movement of the cloth is detected. Since the body portion including the light detection portion can be detachably attached to the presser bar of the sewing machine, the body portion is installed on the presser bar when the detection of the movement of the cloth is required. The pressing support portion can be detachably attached to the body portion and the pressing support portion can be replaced with any one of the pressing support portions having various shapes to attach it to the body portion. The cloth pressing portion is formed on the pressing support portion and the cloth pressing portion is capable of contacting with the cloth. Thus, the cloth can be prevented from floating up. When the pressing support portion is attached to the body portion, the cloth pressing portion is located lower than the bottom surface of the body portion. Thus, the window portion provided on the bottom surface of the body portion is located upper than the cloth pressing portion of the pressing support portion. Consequently, different from the case where the light detection portion is provided at the position nearly in contact with the cloth, since the light detection portion is separated from the cloth, the detectable range of the light detection portion is widened. As a result, the moving amount of the cloth can be precisely detected.

In the above described invention, a light irradiation portion installed in the body portion for irradiating the cloth with an infrared can be further provided, wherein the light detection portion is capable of detecting the infrared reflected on the cloth.

In the above described configuration, the light irradiation portion is installed in the body portion and the infrared is irradiated on the cloth. Thus, the shadow is generated on the cloth by the infrared irradiated by the light irradiation portion so that the light detection portion can detect the movement of the cloth easily.

In the above described invention, a visible light cut filter for shielding a visible light and transmitting the infrared can be provided on the window portion.

In the above described configuration, the visible light introduced in the light detection portion from the outside is reduced. When detecting the visible light, the detected moving amount may differ depending on the difference of the color of the cloth. On the other hand, when detecting the infrared, the color of the cloth due to the visible light is ignored. Thus, the difference of the moving amount detected by the difference of the color of the cloth is reduced. Consequently, the detection accuracy can be improved.

In the above described invention, the light irradiation portion and the light detection portion can be installed in the body portion so that the light irradiated by the light irradiation portion and reflected on a surface of a ruler does not enter the light detection portion when the ruler is inserted between the pressing support portion and a needle plate of the sewing machine.

In the above described configuration, even when the ruler (e.g., quilt measuring ruler) is used while being inserted between the pressing support portion and the needle plate of the sewing machine, the halation is not generated in the detection result of the light detection portion by the influence of the light reflected on the surface of the ruler. Thus, the light detection portion can surely detect the light reflected on the cloth.

In the above described invention, the pressing support portion can include a mounting portion configured to be detachably attached to a side surface of the body portion, a bottom portion of the mounting portion can be located on a position separated from the needle plate of the sewing machine, and the cloth pressing portion is provided lower than the bottom portion of the mounting portion.

In the above described configuration, since the bottom portion of the mounting portion is located on the position separated from the needle plate of the sewing machine, a space is formed between the bottom portion of the mounting portion and the needle plate of the sewing machine. In addition, since the cloth pressing portion is provided lower than the bottom portion of the mounting portion, a space is formed around the side surface of the cloth pressing portion.

In the above described invention, the pressing support portion can include a mounting portion configured to be detachably attached to a side surface of the body portion, a wall portion extended to a height position of the cloth pressing portion can be provided on the mounting portion, and the wall portion can have a shape surrounding the window portion.

In the above described configuration, since the wall portion of the mounting portion is extended to the height position of the cloth pressing portion, looseness of the cloth can be prevented between the bottom portion of the body portion and the needle plate. Since the wall portion of the mounting portion has the shape surrounding the window portion, the light which functions as a disturbance not related to the movement of the cloth can be prevented from entering the light detection portion.

In the above described invention, a display portion configured to be lighted on and off can be provided on the body portion, and the display portion can be lighted on and off in accordance with an operation state of the sewing machine.

In the above described configuration, since the display portion is lighted on and off in accordance with the operation state of the sewing machine, the operator can easily recognize the operation state of the sewing machine. The operation state of the sewing machine is, for example, the start and end of the mode of vertically moving the needle in accordance with the movement of the cloth. For example, when the above described mode is started, the vertical movement of the needle is started when the cloth is moved from the state that the motor of the sewing machine is stopped and the vertical movement of the needle is stopped. The operator can recognize whether the mode of vertically moving the needle in accordance with the movement of the cloth is started or finished by checking on or off of the lighting of the display portion.

In the above described invention, the pressing support portion can include a rotation fulcrum portion provided on both side surfaces of the pressing support portion and protruded toward a back surface of the pressing support portion, and the body portion can include a rotation fulcrum receiving portion corresponding to the rotation fulcrum portion, the rotation fulcrum receiving portion being provided on both side surfaces of the body portion.

In the above described configuration, the rotation fulcrum portion of the pressing support portion is inserted into the rotation fulcrum receiving portion of the body portion. Then, the pressing support portion is pressed upward using the rotation fulcrum portion as an axis. The pressing support portion and the body portion can be moved using the rotation fulcrum portion as an axis. Thus, the operator can mount the pressing support portion to the body portion easily and certainly.

In the above described invention, the body portion can include a button provided on a back surface of the body portion and a fixing pin protruded from a side surface of the body portion, the fixing pin being capable of interlocking with the button, the pressing support portion can include a pin hole provided on the side surface of the pressing support portion, the pin hole being capable of engaging with the fixing pin, and an engagement of the fixing pin to the pin hole can be configured to be released by pressing the button.

In the above described configuration, the fixing pin of the body portion and the pin hole of the pressing support portion are engaged with each other. Thus, the pressing support portion is fixed to the body portion. In addition, when the button is pressed, the engagement of the fixing pin to the pin hole is released and the pressing support portion is removed downward from the body portion.

The sewing machine of the present invention includes: the above described cloth movement detection device; and a controller configured to control an operation of a motor for moving a needle of the sewing machine based on the movement of the cloth detected by the cloth movement detection device.

In the above described configuration, the operation of the motor for moving the needle of the sewing machine is controlled based on the movement of the cloth detected by the cloth movement detection device. Thus, the rotation speed is increased when the moving speed of the cloth is increased while the rotation speed is decreased when the moving speed of the cloth is decreased. Consequently, the needle can be operated to obtain a constant sewn pitch, for example.

In the above described invention, the controller can include: an input receiving section configured to receive an input related to an adjustment of a sensitivity of the light detection portion; and a speed adjustment section configured to adjust a rotation speed of the motor based on an information inputted from the input receiving section.

In the above described configuration, the rotation speed of the motor is adjusted based on the information inputted by the input receiving section. For example, when the actually sewn pitch is different from the specified sewn pitch, the operator can make the actually sewn pitch closer to the specified sewn pitch.

By using the present invention, the movement of the cloth can be precisely detected.

DETAILED DESCRIPTION OF THE INVENTION

Figure 1:
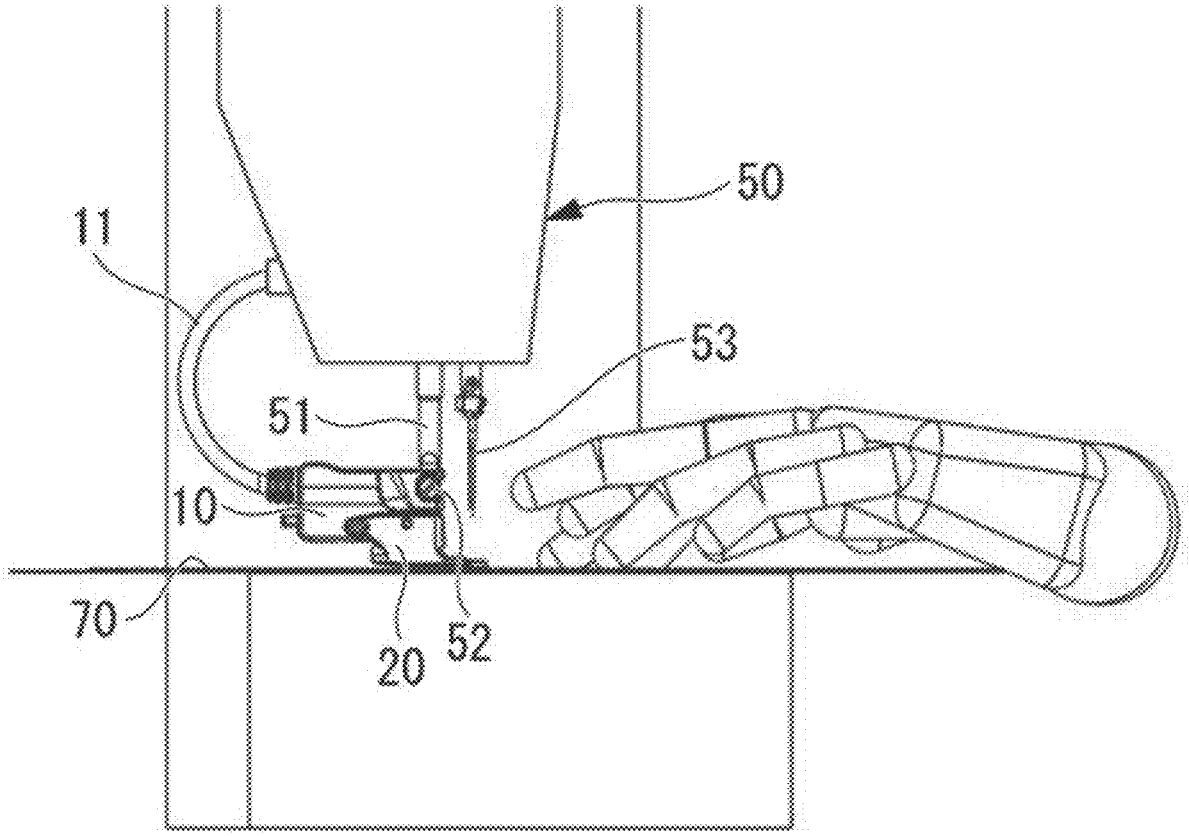
FIG. 1 is a side view showing a sewing machine and a cloth movement detection device of an embodiment of the present invention.
Figure 2:
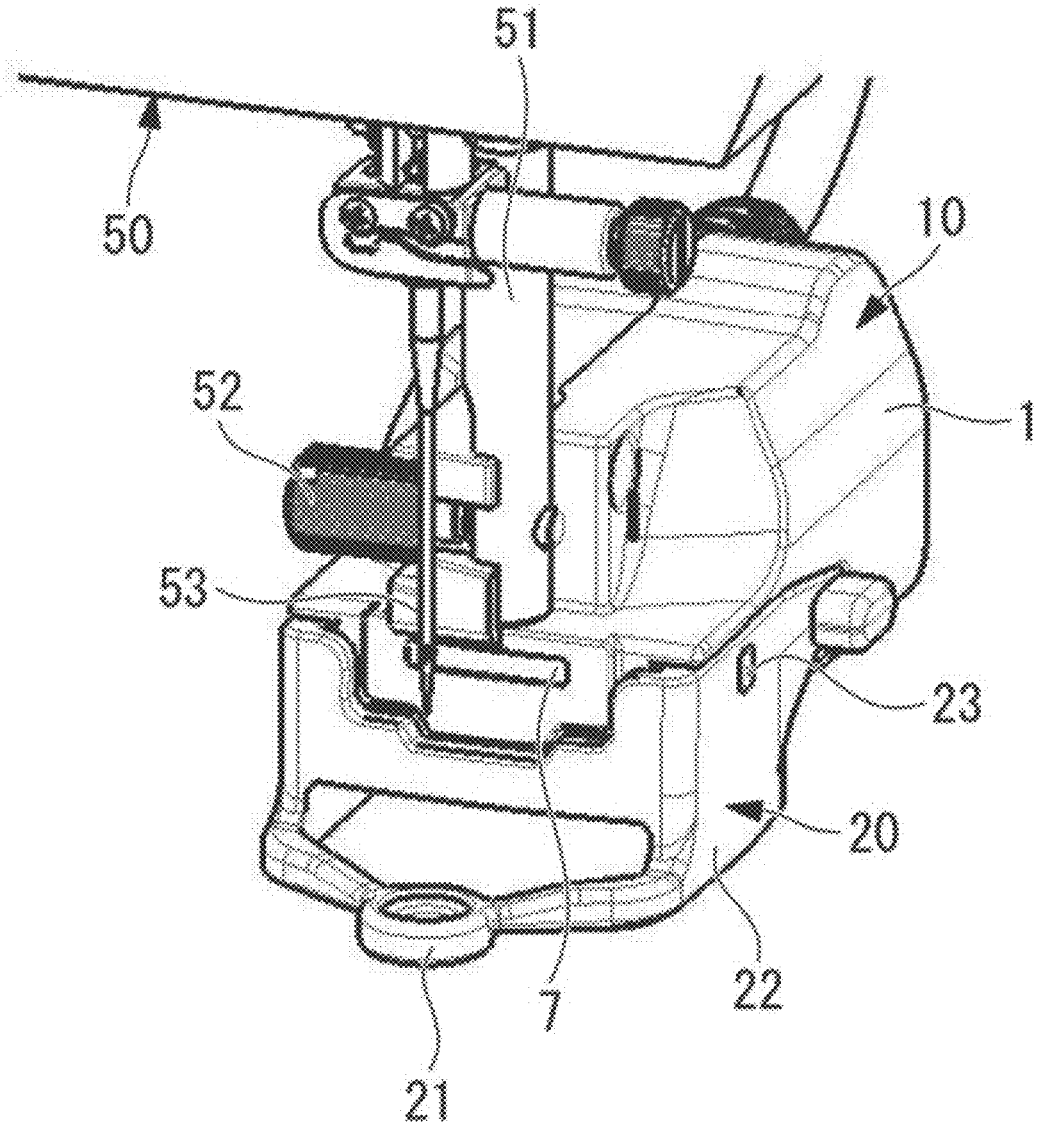
FIG. 2 is a perspective view showing the cloth movement detection device of an embodiment of the present invention in a state of being attached to a presser bar.

Hereafter, an embodiment of the present invention will be explained with reference to the drawings. A later described cloth movement detection device 10 of the present embodiment can be attached to and detached from a sewing machine 50 of an embodiment of the present invention. FIG. 1 and FIG. 2 show a state that the cloth movement detection device 10 is installed in the sewing machine 50. In addition, the sewing machine 50 of the present embodiment can receive the data related to a moving amount of a cloth 70 detected by the cloth movement detection device 10 and control to drive a needle 53 in a vertical direction based on the received data, for example. Namely, the sewing machine 50 of the present embodiment includes a controller 5 which is compatible with the cloth movement detection device 10.

The cloth movement detection device 10 is a component detachably attached to a presser bar 51 of the sewing machine 50. The cloth movement detection device 10 includes a body portion 1, a pressing support portion 20 and the like. In the cloth movement detection device 10, the pressing support portion 20 can be detachably attached to the body portion 1.

The body portion 1 includes a casing having a shape attachable to the presser bar 51 at an upper part of a front surface side of an outer peripheral portion of the body portion 1, for example. The body portion 1 is sandwiched between the presser bar 51 and a locking screw 52 and fixed to the presser bar 51. The pressing support portion 20 is attached to and detached from the body portion 1 at a lower part of the outer peripheral portion of the body portion 1. Since the body portion 1 can be attached to and detached from the presser bar 51 of the sewing machine 50, the body portion 1 is installed in the presser bar 51 when the detection of the movement of the cloth 70 is required.

Figure 5:
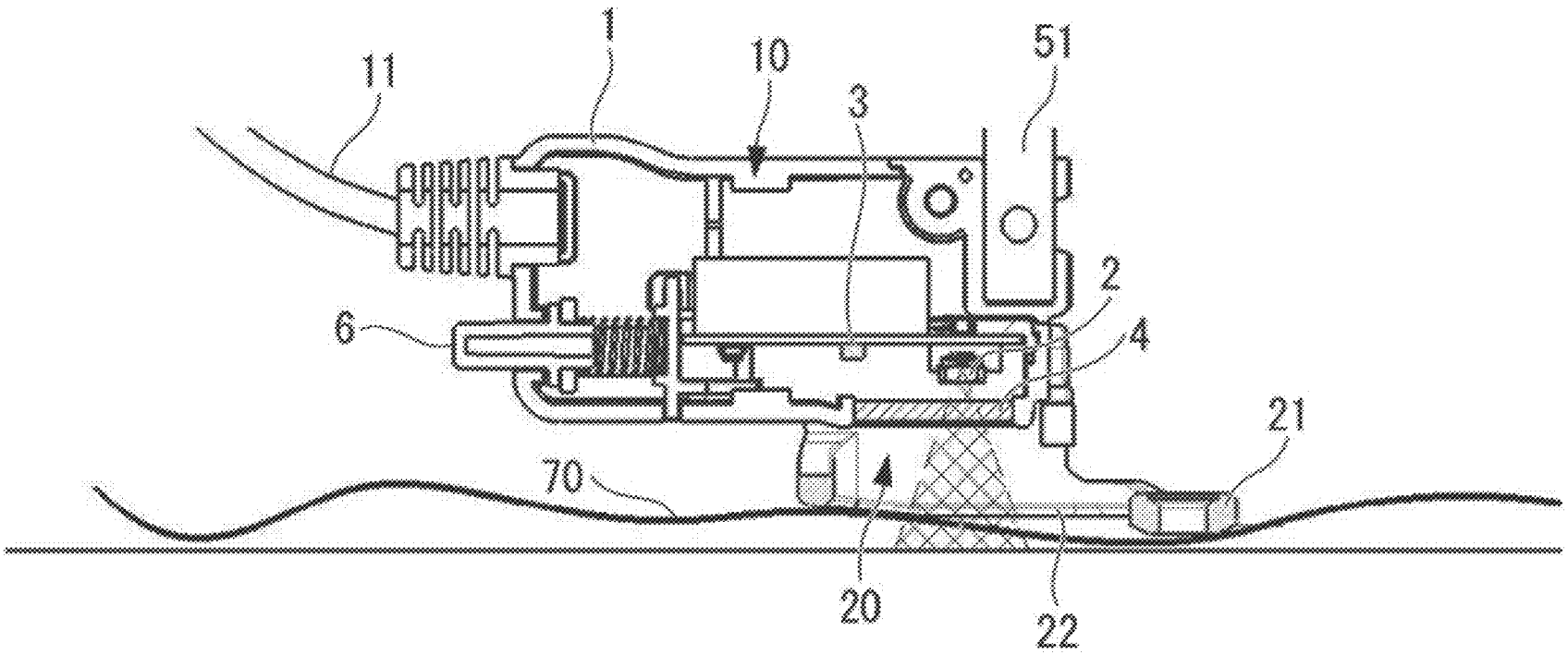
FIG. 5 is a vertical cross-sectional view showing the cloth movement detection device of an embodiment of the present invention in a state of being attached to the presser bar.

As shown in FIG. 5, the body portion 1 includes a light detection portion 2, a light irradiation portion 3, a window portion 4 and the like. The light detection portion 2 detects the light for detecting the movement of the cloth 70 (i.e., the position change of the cloth 70). The light detection portion 2 is an image sensor for imaging an object and converting an imaging result to an electrical signal. The light detection portion 2 is an infrared image sensor capable of detecting the infrared wavelength of the object, for example. The light detection portion 2 detects the moving amount of the object per unit time based on the imaging result and transmits the detected result to the controller 5.

The light irradiation portion 3 irradiates the cloth 70 installed in the sewing machine 50 with the light. The light irradiation portion 3 is a light emitting diode (LED), for example. When irradiating the infrared, the light irradiation portion 3 is an infrared LED.

Figure 3:
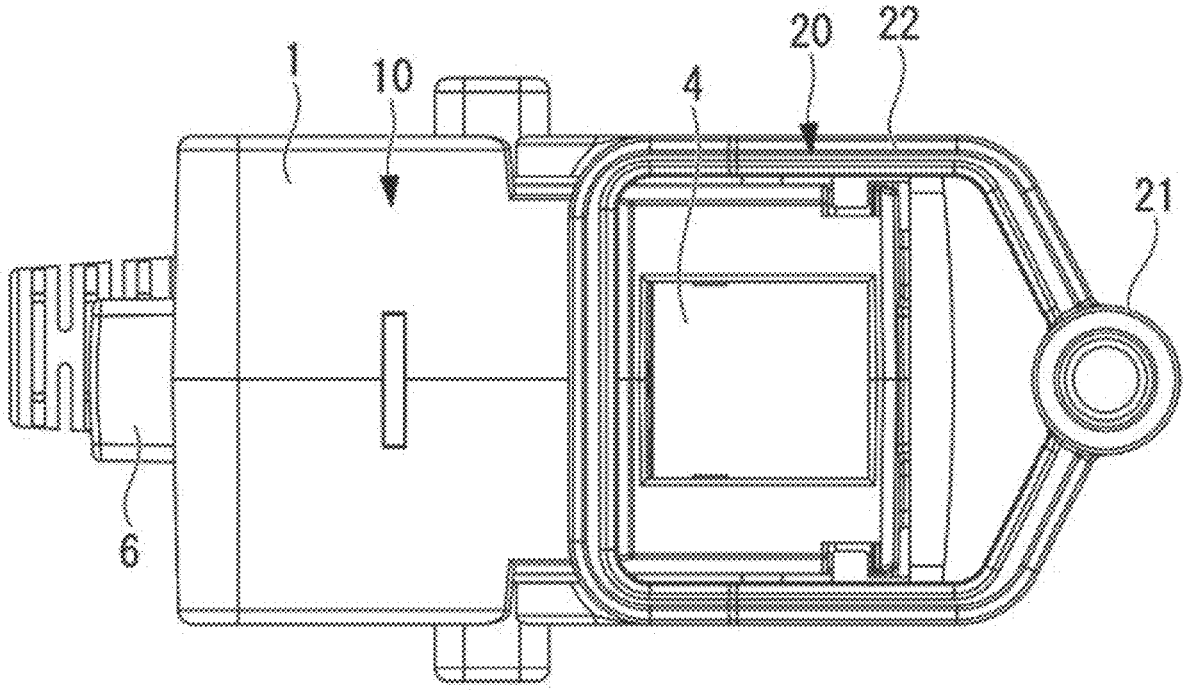
FIG. 3 is a bottom view showing the cloth movement detection device of an embodiment of the present invention.

The window portion 4 is made of a material such as a plastic, which is a member capable of transmitting light. As shown in FIG. 3, the window portion 4 is provided on the bottom surface of the body portion 1. When the light detection portion 2 detects the infrared, the window portion 4 is a visible light cut filter for shielding a visible light and transmitting the infrared. Consequently, the visible light introduced in the light detection portion 2 from the outside is reduced, and the difference of the moving amount detected by the difference of the color of the cloth 70 is reduced. Thus, detection accuracy can be improved.

When the surface of the cloth 70 receives the light such as natural light, room light and the light from a lighting device mounted in the sewing machine 50 from many directions in addition to the light from the light irradiation portion 3, the shadow of the cloth 70 disappears. In addition, when the light from the outside is changed or when the shadow of an object and a person reflected in the cloth 70 is moved, the light detection portion 2 may erroneously detect it as the movement of the cloth 70. On the other hand, when the infrared RED is used as the light irradiation portion 3 and the visible light cut filter is used as the window portion 4, the influence of the light from the outside can be reduced and the shadow generated by the light irradiation portion 3 can be maintained.

Figure 6:
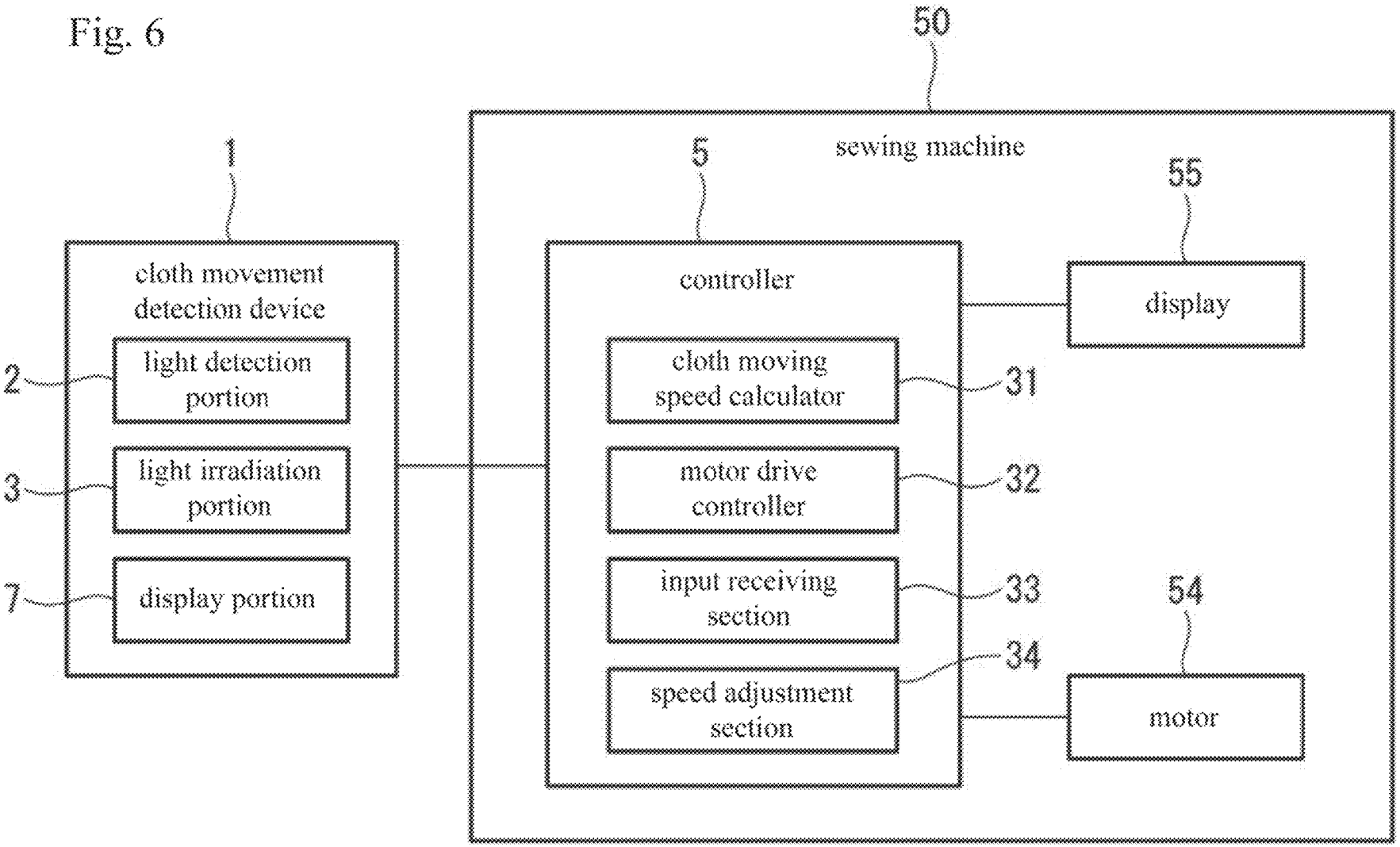
FIG. 6 is a block diagram showing the sewing machine and the cloth movement detection device of an embodiment of the present invention.

As shown in FIG. 6, the controller 5 includes a cloth moving speed calculator 31, a motor drive controller 32 and the like. The controller 5 includes, a CPU, a memory, a storage unit and the like. Various operations are achieved by programs.

The cloth moving speed calculator 31 calculates the moving speed of the object (i.e., cloth 70) based on the moving amount of the object detected by the light detection portion 2.

The motor drive controller 32 calculates the rotation speed of a motor 54 for moving the needle 53 in the vertical direction based on the calculated moving speed of the cloth 70 and the sewn pitch specified by an operator. The motor drive controller 32 controls the operation of the motor 54 based on the calculated rotation speed of the motor 54. Consequently, regardless of the moving speed of the cloth 70, the operation of the motor 54 is controlled so that the sewn pitch becomes constant (specified sewn pitch).

Figure 20:
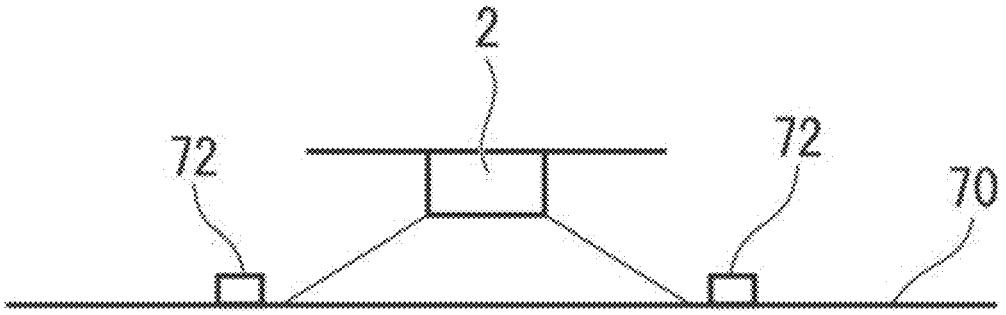
Related Art Fig. 20
FIG. 20 is a schematic diagram showing a positional relation between the light detection portion and the cloth of a comparative example.

The body portion 1 is attached to the presser bar 51 so that the bottom surface of the body portion 1 is located at the position separated from the surface of the cloth 70 without being in contact with the cloth 70. The light detection portion 2 captures the characteristic point of the cloth 70 such as a pattern of the surface and detects the moving amount of the characteristic point. In the conventional configuration, when the light detection portion is provided at the position nearly in contact with the cloth 70 as shown in FIG. 20, a detectable range is narrow compared to the case of the present embodiment where the light detection portion 2 is separated from the cloth 70. In the conventional configuration, the object to be imaged and captured is limited. Thus, even when the cloth 70 is actually moved, the characteristic point may not be recognized in the captured image depending on the type and color of the cloth 70. In such a case, the temporal change of the object cannot be detected or a characteristic point 72 cannot be tracked.

Figure 19:
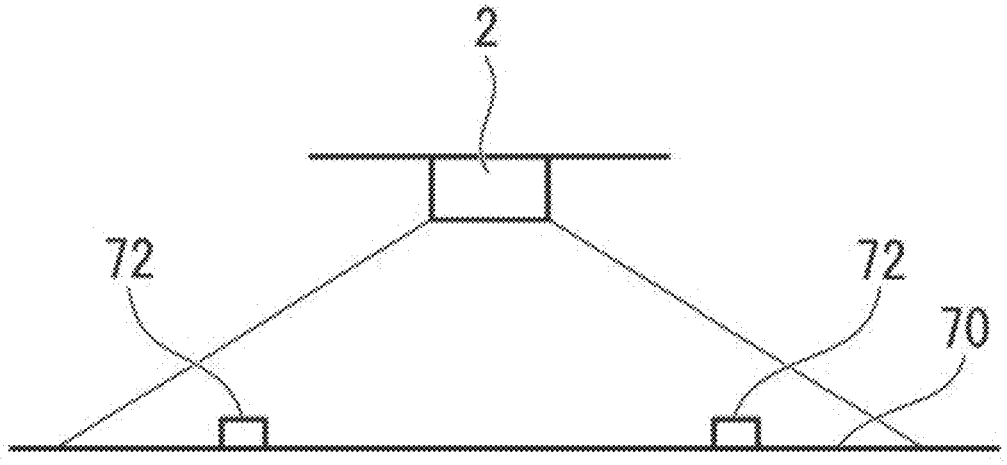
FIG. 19 is a schematic diagram showing a positional relation between the light detection portion and the cloth of the cloth movement detection device of an embodiment of the present invention.

On the other hand, in the present embodiment, as shown in FIG. 19, since the position of the bottom surface of the body portion 1 is separated from the cloth 70, the detectable range of the light detection portion 2 is widened. As a result, the objects to be imaged and captured are increased. Thus, the characteristic point 72 can be more easily recognized when the position of the characteristic point 72 varies in accordance with the actual movement of the cloth 70. The change of the object can be surely detected in the captured image and the characteristic point 72 can be easily tracked. Thus, the moving amount of the cloth 70 can be detected correctly. More specifically, when using the cloth such as a laminate having little unevenness on the surface and a velvet having a fine and glossy surface, it is difficult to detect the moving amount of the cloth in the conventional light detection portion installed at the position nearly in contact with the cloth. On the other hand, in the present embodiment, the detective range of the light detection portion 2 is widened. Thus, the pattern of the surface of the cloth 70, the sewn thread and dust adhered to the surface can be imaged and recognized as the characteristic point 72. Consequently, the moving amount of the cloth 70 can be detected even in the cloth such as the laminate and the velvet.

In the sewing machine 50 to which the present embodiment is applied, a cloth movement detection mode where the vertical movement of the needle 53 is started when the movement of the cloth 70 by hand is detected by the cloth movement detection device 10 and a normal sewing mode where the cloth 70 is mechanically moved by using a normal feeding mechanism can be switched. The cloth movement detection mode can be selected by pressing a specially provided switching button displayed on a display 55 of the sewing machine 50. It is also possible to display the specially provided switching button on the display 55 when the cloth movement detection device 10 is installed and a cable 11 is connected so that the signals can be electrically transmitted.

When the cloth 70 is fed by hand, it is also possible to stop the rotation of the motor 54 and display a warning or generate a warning sound when the moving speed of the cloth 70 is a predetermined threshold value or more based on the detected moving amount.

Then, the pressing support portion 20 attachable to and detachable from the body portion 1 will be explained. In the present embodiment, various kinds of pressing support portions 20 are preliminarily prepared and an operator can switch the pressing support portion 20 to the one having the shape suitable for the sewing operation and usability. Namely, the pressing support portion 20 is configured to be detachably attached to the body portion 1 and the pressing support portion 20 can be replaced with any one of the pressing support portions having various shapes to attach it to the body portion 1.

As shown in FIG. 2 to FIG. 5, the pressing support portion 20 includes a cloth pressing portion 21 capable of contacting with the cloth 70. The cloth pressing portion 21 has a shape for preventing the cloth 70 from floating up near the needle location. A clearance through which only the cloth 70 or the like can pass is formed between the bottom surface of the cloth pressing portion 21 and the needle plate.

When the pressing support portion 20 is attached to the body portion 1, the cloth pressing portion 21 is located lower than the bottom surface of the body portion 1. Thus, the window portion 4 provided on the bottom surface of the body portion 1 is located upper than the cloth pressing portion 21 of the pressing support portion 20. Consequently, different from the case where the light detection portion 2 is located at the position nearly in contact with the cloth 70 as shown in FIG. 20, the light detection portion 2 is separated from the cloth 70 and the detectable range the light detection portion 2 is widened as shown in FIG. 19. As a result, the moving amount of the cloth 70 can be precisely detected.

Figure 12:
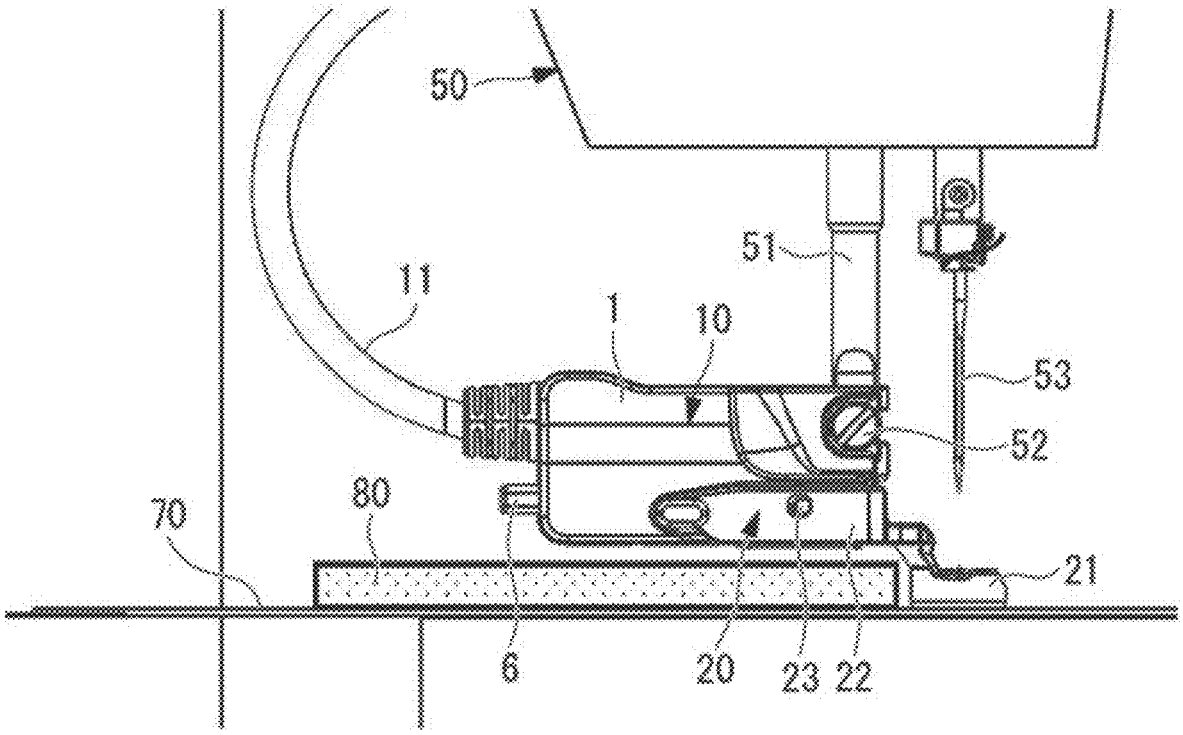
FIG. 12 is a cross-sectional view showing the cloth movement detection device of an embodiment of the present invention in a state of being attached to the presser bar.
Figure 13:
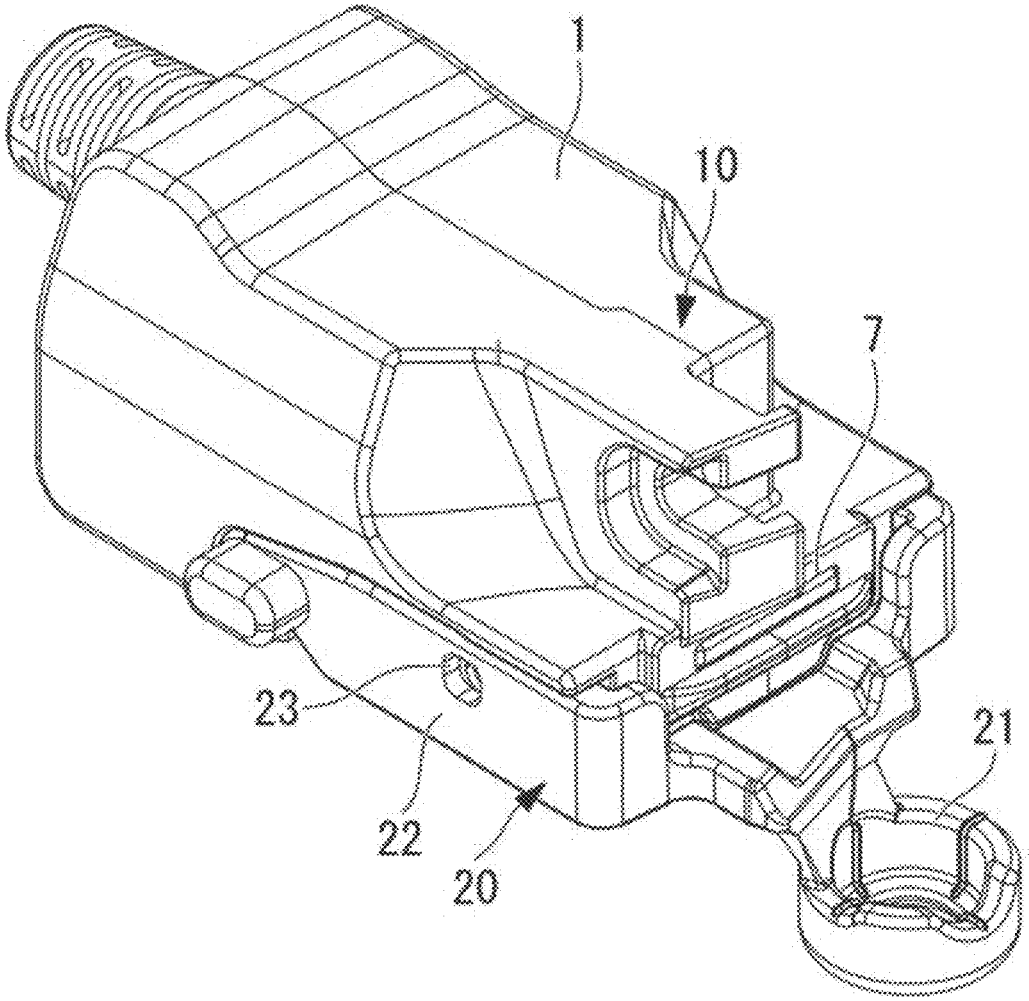
FIG. 13 is a perspective view showing the cloth movement detection device of an embodiment of the present invention.

The pressing support portion 20 used with a quilt measuring ruler 80 will be explained with reference to FIG. 12 and FIG. 13.

In this case, the cloth pressing portion 21 of the pressing support portion 20 has a circular shape surrounding the needle location. The pressing support portion 20 includes a mounting portion 22 configured to be fixable to the side surface of the body portion 1. The mounting portion 22 is a plate member formed along the side surface of the body portion 1. A pin hole 23 is formed on an upper part of the mounting portion 22. A bottom portion of the mounting portion 22 is provided at the positon separated from the needle plate so that a space is formed between the bottom portion of the mounting portion 22 and the needle plate of the sewing machine 50. When the pressing support portion 20 is attached to the body portion 1, the bottom portion of the mounting portion 22 is separated from the needle plate by approximately 5 mm, for example.

In addition, when the pressing support portion 20 is attached to the body portion 1, the cloth pressing portion 21 is provided at the position lower than the bottom portion of the mounting portion 22 so that a space is formed around the side surface of the cloth pressing portion 21.

Figure 11:
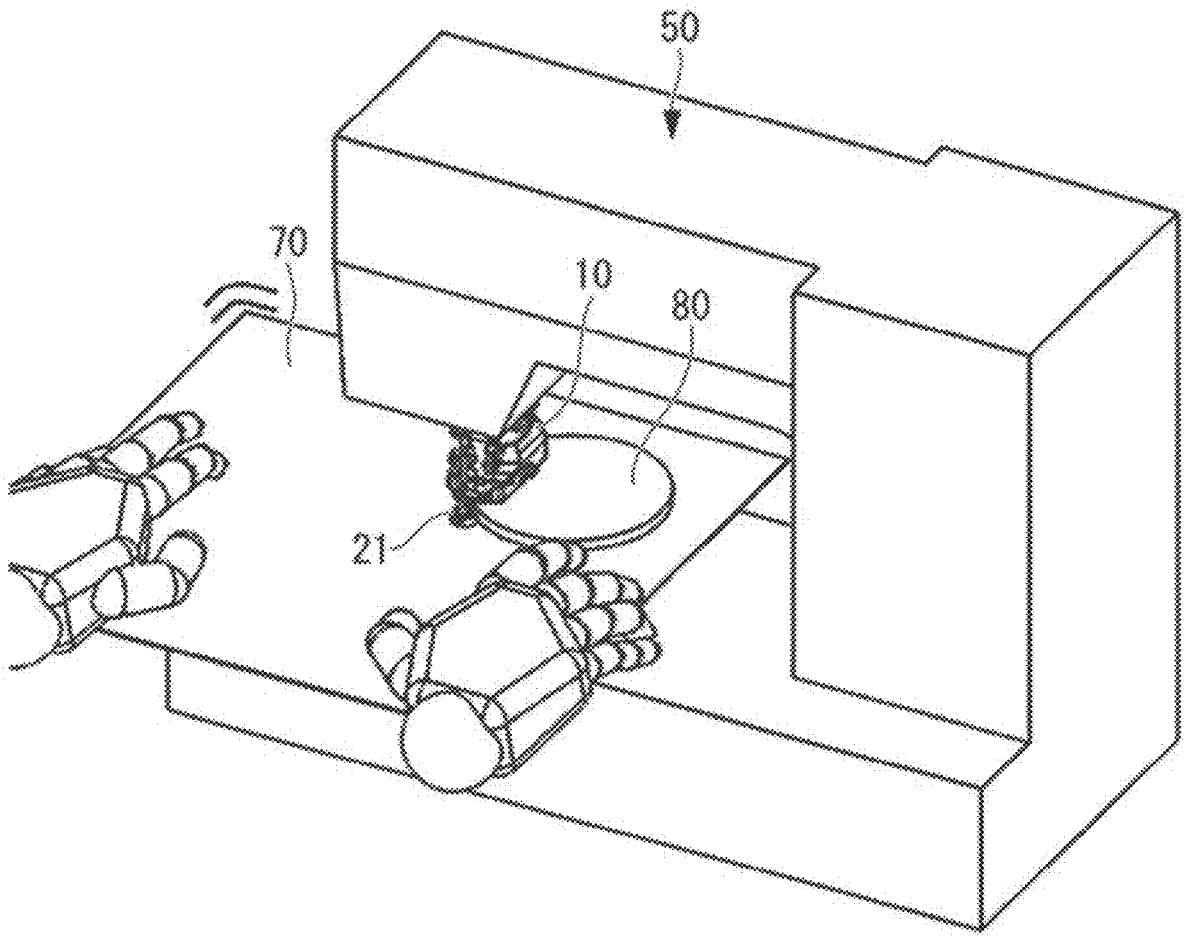
FIG. 11 is a perspective view showing the sewing machine of an embodiment of the present invention in a state of using a quilt measuring ruler.

Since the cloth pressing portion 21 is located lower than the mounting portion 22 and the space is formed between the bottom surface of the body portion 1 and the needle plate and around the cloth pressing portion 21, the quilt measuring ruler 80 other than the cloth 70 can be inserted into the space. Consequently, as shown in FIG. 11, the quilt measuring ruler 80 is pressed against the periphery of the circular cloth pressing portion 21 and the quilt measuring ruler 80 and the cloth 70 are simultaneously moved while being guided by the periphery of the cloth pressing portion 21. Thus, the pattern corresponding to the shape formed on the quilt measuring ruler 80 can be sewn on the cloth 70.

The pressing support portion 20 where the sewing is performed without using the quilt measuring ruler 80 will be explained with reference to FIG. 2 to FIG. 5.

In this case, in the pressing support portion 20, the wall portion of the mounting portion 22 is extended to the height position of the cloth pressing portion 21 and the wall portion has the shape surrounding the window portion 4.

Figure 14:
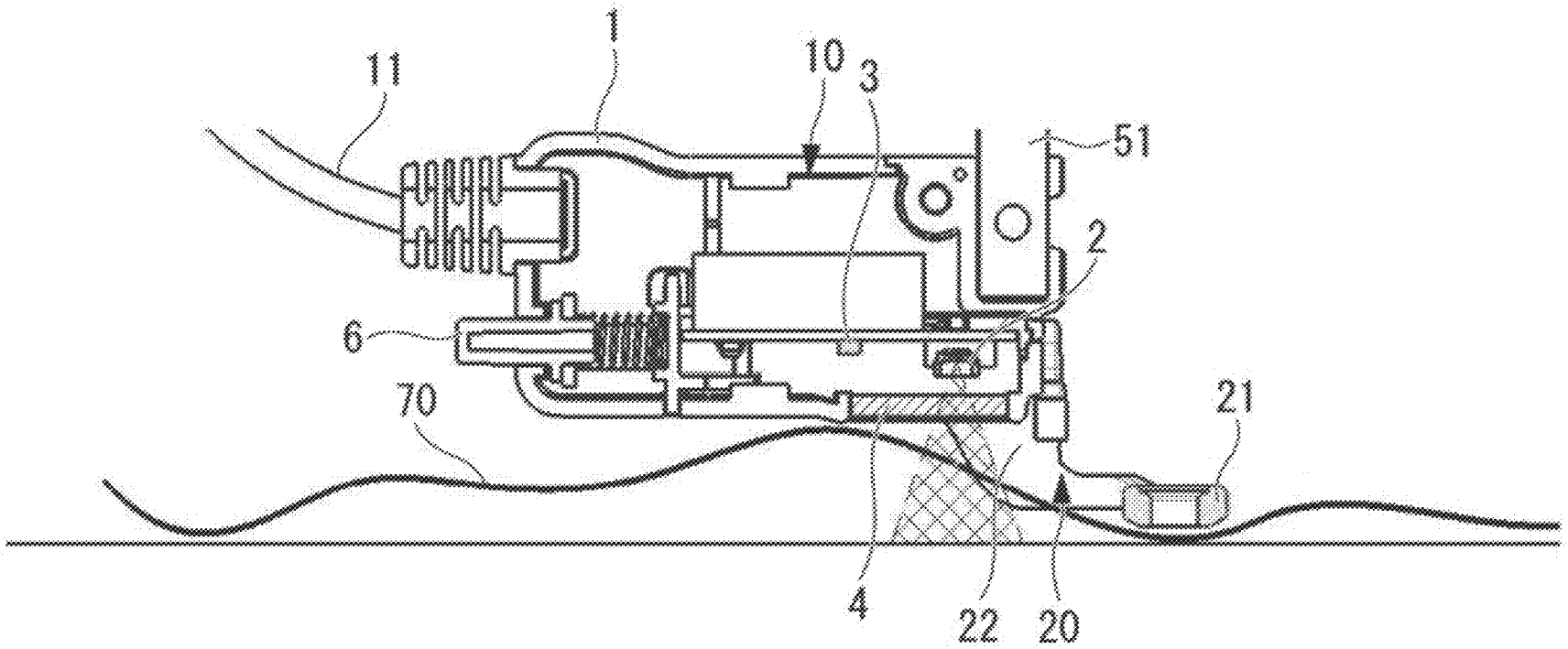
FIG. 14 is a vertical cross-sectional view showing the cloth movement detection device of an embodiment of the present invention in a state of being attached to the presser bar.

When the above described pressing support portion 20 used together with the quilt measuring ruler 80 is attached and the sewing is performed without using the quilt measuring ruler 80 as shown in FIG. 14, the cloth 70 is loosened between the bottom surface of the body portion 1 and the needle plate and unevenness is caused. Thus, the movement of the cloth 70 cannot be detected correctly by the light detection portion 2.

Different from the case where the space is formed around the side surface of the cloth pressing portion 21, since the wall portion of the mounting portion 22 is extended to the height position of the cloth pressing portion 21, looseness of the cloth 70 can be prevented between the bottom surface of the body portion 1 and the needle plate as shown in FIG. 5. As a result, since the distance between the light detection portion 2 and the cloth 70 is kept constant, the moving amount of the cloth 70 can be detected correctly.

Figure 9:
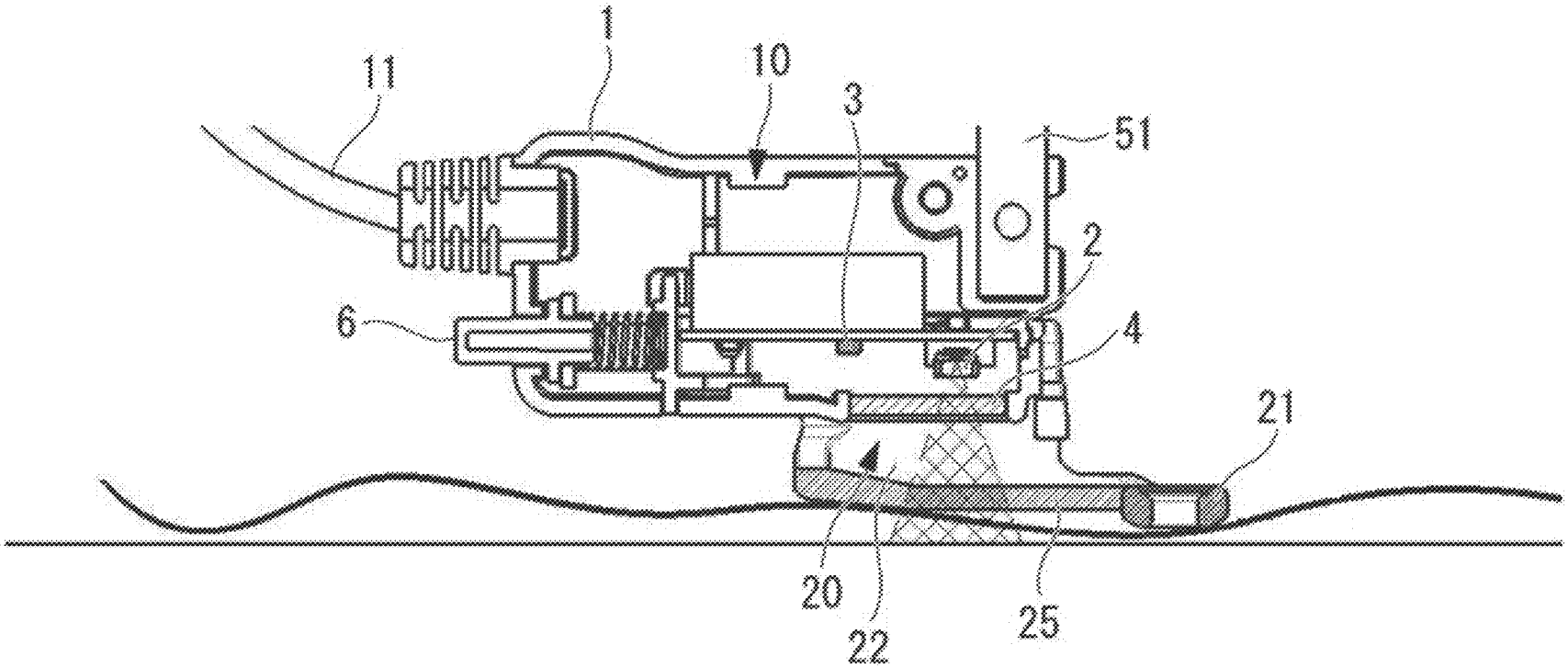
FIG. 9 is a vertical cross-sectional view showing the cloth movement detection device of an embodiment of the present invention in a state of being attached to the presser bar.

In addition, since the wall portion of the mounting portion 22 has the shape surrounding the window portion 4, the distance between the light detection portion 2 and the cloth 70 can be kept constant and the light which functions as a disturbance not related to the movement of the cloth 70 can be prevented from entering the light detection portion 2. Instead of the wall portion having the shape surrounding the window portion 4, a transparent plate member 25 can be provided on the pressing support portion 20 so that the plate member 25 is approximately parallel to the needle plate as shown in FIG. 9. The looseness of the cloth 70 between the bottom surface of the body portion 1 and the needle plate can be prevented by the plate member 25.

Figure 8:
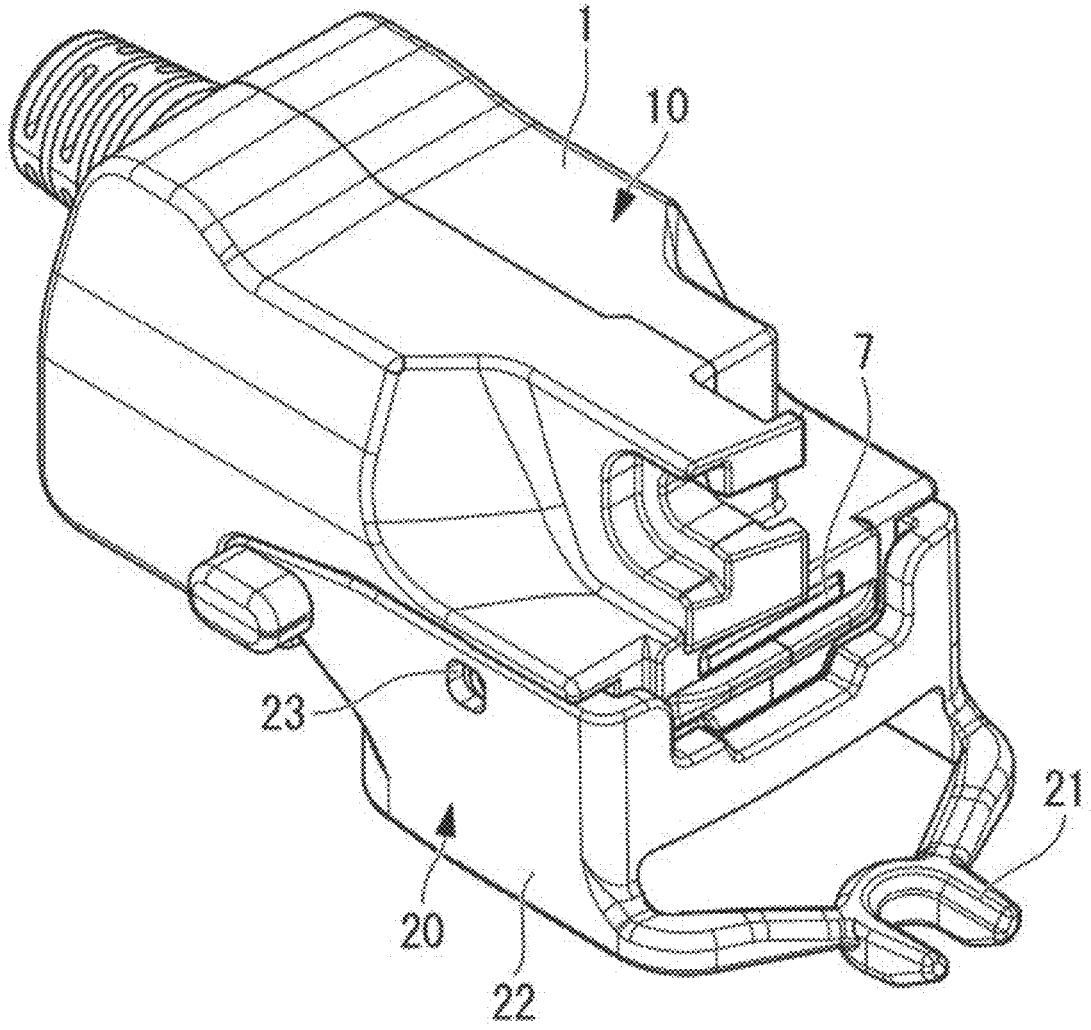
FIG. 8 is a perspective view showing the cloth movement detection device of an embodiment of the present invention.
Figure 10:
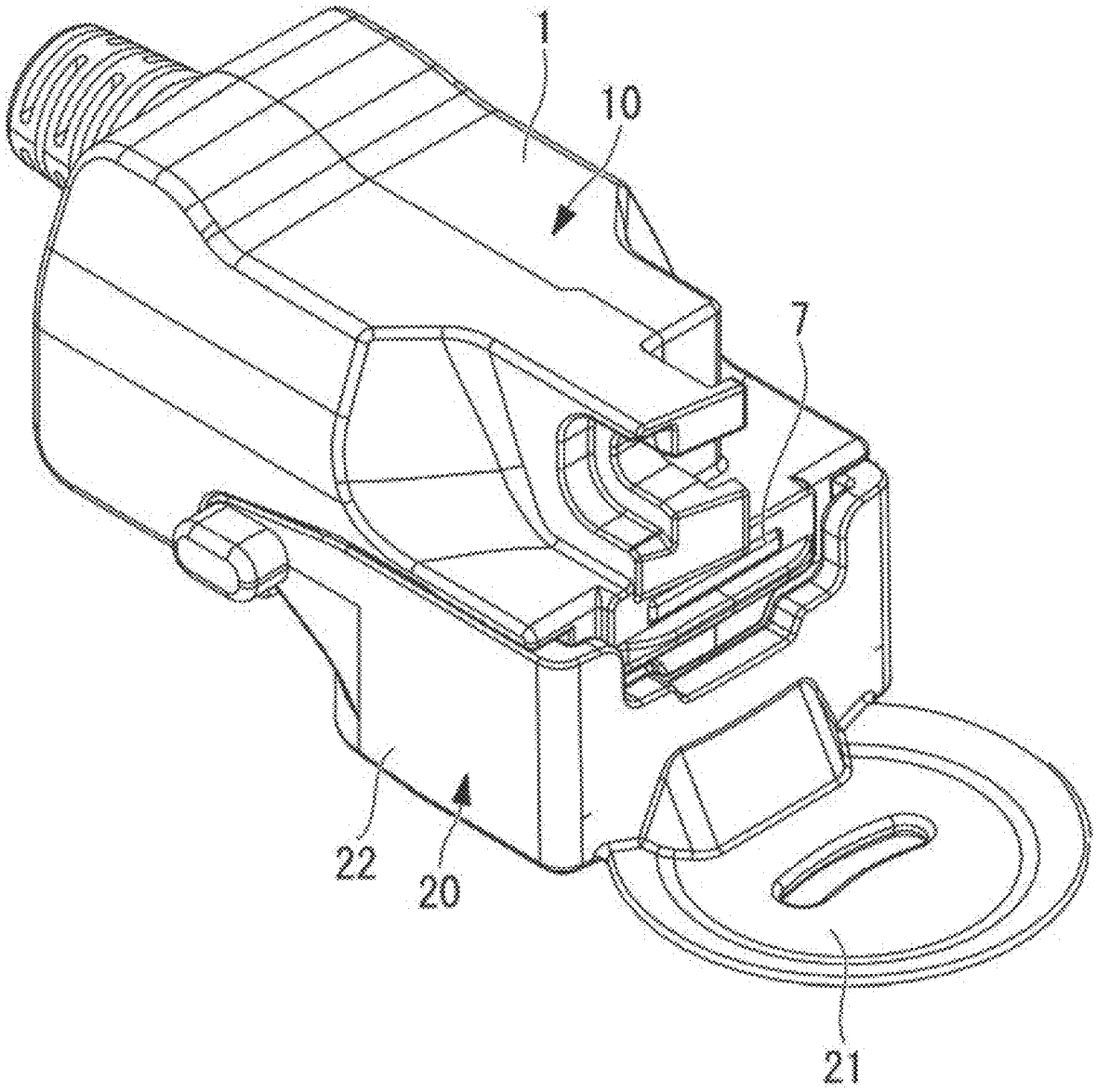
FIG. 10 is a perspective view showing the cloth movement detection device of an embodiment of the present invention.

In addition, the shape of the cloth pressing portion 21 is not limited to the above described example. The cloth pressing portion 21 can be formed in an approximately U-shape in a plan view so that front part of the cloth pressing portion 21 is opened as shown in FIG. 8, or the cloth pressing portion 21 can be formed in a circular plate (disk) shape as shown in FIG. 10.

Then, a display portion 7 provided on the body portion 1 will be explained.

The display portion 7 can be lighted (turned) on and off. As shown in FIG. 2 and other figures, the display portion 7 is provided on the front part of the body portion 1. The display portion 7 is formed by an LED and the like, for example. When the cloth 70 is moved, the display portion 7 is lighted on or off in accordance with the operation of turning on or off the cloth movement detection mode for starting the vertical movement of the needle 53. The cloth movement detection mode is the state of performing the operation using the cloth movement detection device 10. When the display portion 7 is lighted on, it indicates that the cloth movement detection mode is turned on. When the display portion 7 is lighted off, it indicates that the cloth movement detection mode is turned off.

In the present embodiment, when the operation using the cloth movement detection device 10 is started by the operator, the display portion 7 is lighted on. Consequently, even when the needle 53 is stopped, the operator can recognize that the cloth movement detection mode is started. If the display portion 7 is not provided, the operator should check the start and the end of the cloth movement detection mode by using a display provided on a body of the sewing machine, for example. On the other hand, since the display portion 7 is provided in the present embodiment, the operator can check the start and the end of the cloth movement detection mode at hand without checking the display. Thus, the operation can be performed safely.

Figure 7:
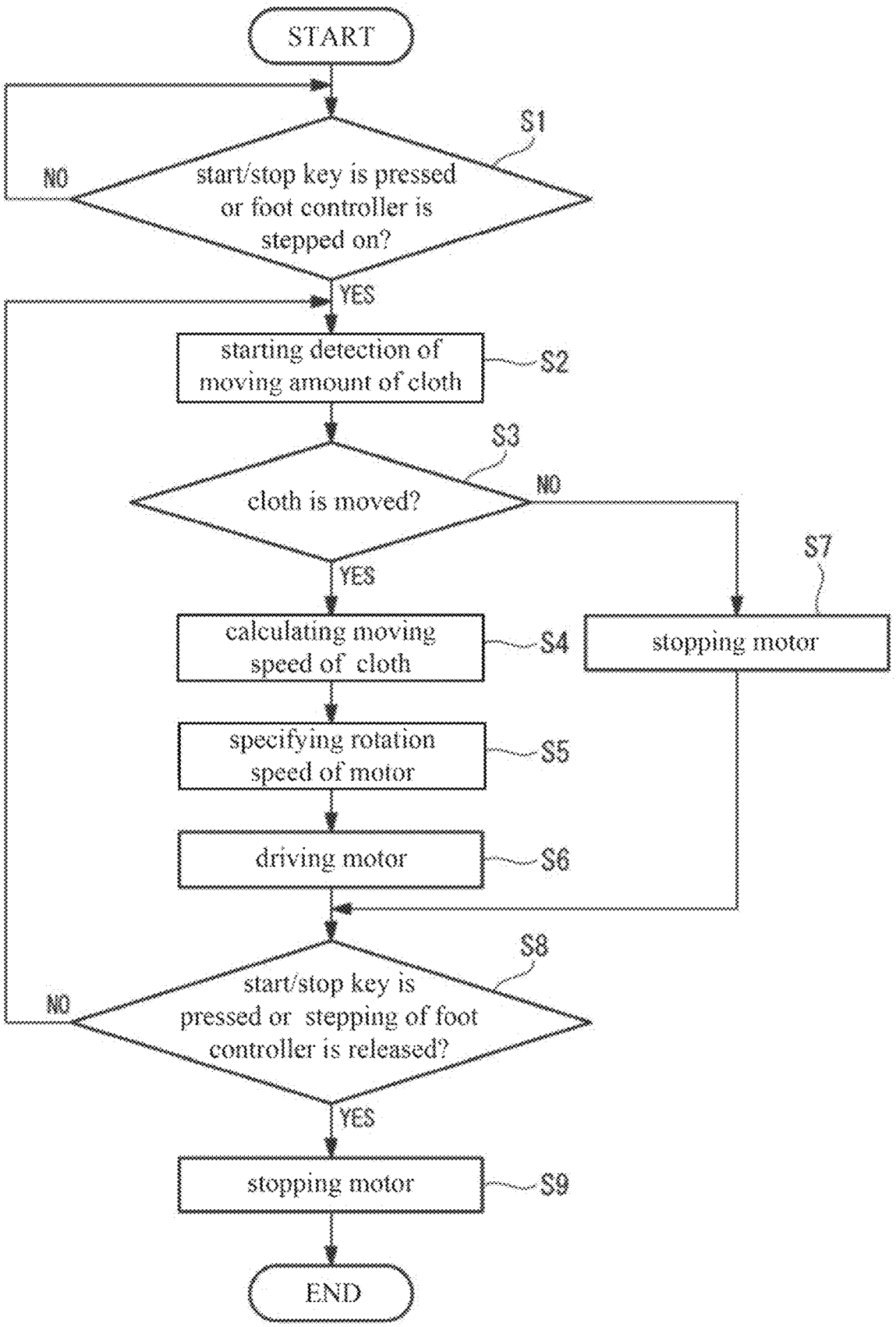
FIG. 7 is a flow chart showing an operation of the sewing machine and the cloth movement detection device of an embodiment of the present invention.

Then, the movement of the sewing operation in the cloth movement detection mode provided with the cloth movement detection device 10 will be explained with reference to FIG. 7.

Once the cloth movement detection mode is started, the vertical movement of the needle 53 is stopped when the movement of the cloth 70 is stopped while the vertical movement of the needle 53 is started by driving the motor 54 when the cloth 70 is moved. When the cloth 70 is moved, the moving speed of the cloth 70 is calculated and the rotation speed of the motor 54 is changed in accordance with the moving speed of the cloth 70. The sewing is performed to form the seams at a predetermined sewn pitch by changing the moving speed of the needle 53 in the vertical direction.

The cloth movement detection mode is started when a start/stop key provided on the sewing machine 50 is pressed or a foot controller is stepped on by the operator. Therefore, first of all, whether or not the start/stop key is pressed or the foot controller is stepped on is judged (Step S1). When the start/stop key is not pressed or the foot controller is not stepped on, the cloth movement detection mode is not started.

When the start/stop key is judged to be pressed or the foot controller is judged to be stepped on, the light detection portion 2 starts to detect the moving amount of the cloth 70 moved in a unit time (Step S2) and judges whether or not the cloth 70 is moved (Step S3). When the cloth 70 is judged to be moved, the cloth moving speed calculator 31 of the controller 5 calculates the moving speed of the cloth 70 based on the moving amount detected by the light detection portion 2 (Step S4). On the other hand, when the cloth 70 is judged not to be moved (i.e., the moving speed of the cloth 70 is zero), the motor 54 is stopped (Step S7).

When the cloth 70 is judged to be moved and the moving speed is calculated, the motor drive controller 32 specifies the rotation speed of the motor 54 of the sewing machine 50 based on the moving speed of the cloth 70 calculated by the cloth moving speed calculator 31 and the specified sewn pitch (Step S5). Specifically, when the moving speed of the cloth 70 is judged to be increased, the rotation speed of the motor 54 is increased and the movement of the needle 53 in the vertical direction is accelerated. When the moving speed of the cloth 70 is judged to be decreased, the rotation speed of the motor 54 is decreased and the movement of the needle 53 in the vertical direction is decelerated. Then, the motor 54 is driven based on the specified rotation speed and the needle 53 is moved in the vertical direction (Step S6). Consequently, the sewing is performed to form the seams at a predetermined sewn pitch.

In a state that the cloth movement detection mode is started, whether or not the start/stop key is pressed or the stepping of the foot controller is released is judged (Step S8). When the pressing of the start/stop key is judged not to be pressed or the stepping of the foot controller is judged not to be released, the cloth movement detection mode is continued. When the start/stop key provided on the sewing machine 50 is pressed by the operator or the stepping of the foot controller is released, the motor 54 is stopped (Step S9) and the cloth movement detection mode is finished.

Although there is no problem when the operator recognizes that the cloth movement detection mode is started, the operator may not recognize that the cloth movement detection mode is started in some cases, for example, when long time has passed after the cloth movement detection mode is started and the movement of the cloth 70 is stopped. When the cloth 70 is rapidly moved or the cloth 70 is pulled without recognizing that the cloth movement detection mode is started, the motor 54 of the sewing machine 50 may be driven without depending on the intention of the operator and the needle 53 may be moved at high speed in the vertical direction. On the other hand, in the present embodiment, the operator can check the start and the end of the cloth movement detection mode at hand by the display portion 7. When the cloth movement detection mode is started and the display portion 7 is lighted on, the operator is prevented from unexpectedly moving or pulling the cloth 70. Thus, the sewing machine 50 is prevented from driving without depending on the intention of the operator. Therefore, the operator can operate the sewing machine 50 safely.

Then, a mounting mechanism of the pressing support portion 20 will be explained with reference to FIG. 17 and FIGS. 18A to 18D.

Figure 17:
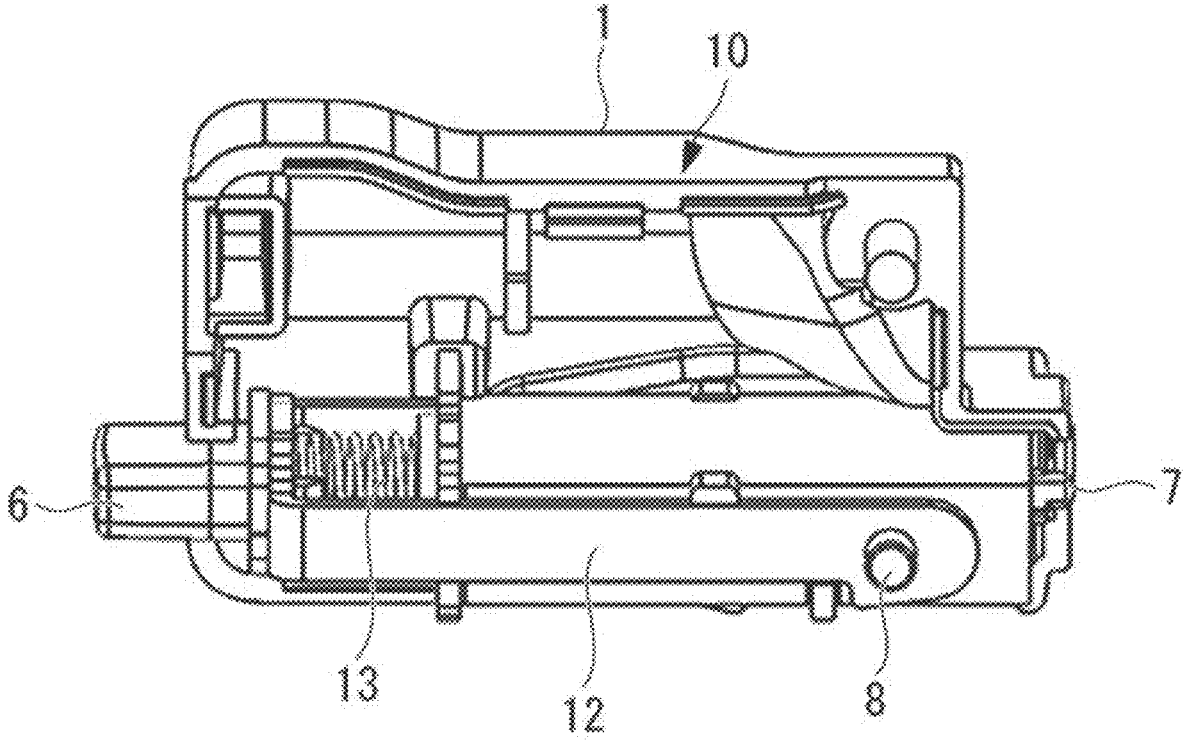
FIG. 17 is a perspective view showing an inside of the cloth movement detection device of an embodiment of the present invention.

As shown in FIG. 17, a button 6 is provided on the rear surface of the body portion 1.

Figure 4:
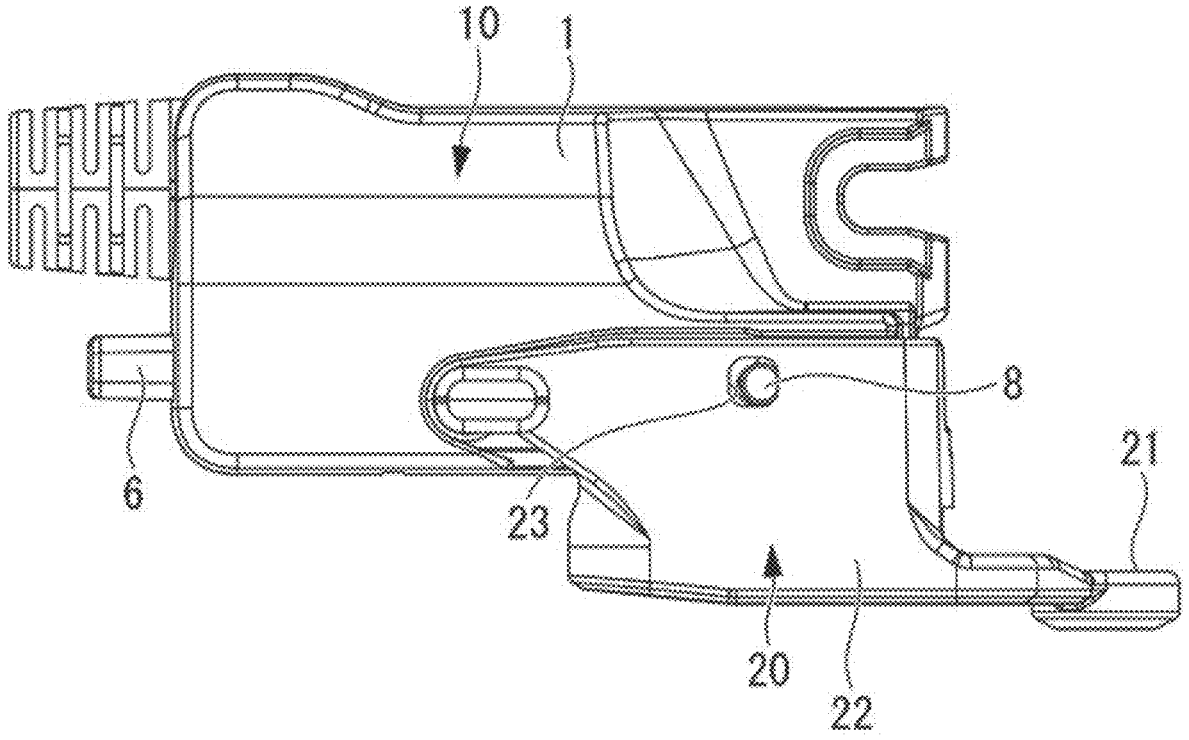
FIG. 4 is a side view showing the cloth movement detection device of an embodiment of the present invention.

When the button 6 is pressed, a fixing pin 8 is moved to the front surface side of the body portion 1. The fixing pin 8 is protruded from the side surface of the body portion 1 and capable of interlocking with the button 6 via a connection portion 12. As shown in FIG. 4, the fixing pin 8 is capable of engaging with the pin hole 23 provided on the side surface of the pressing support portion 20. When the fixing pin 8 and the pin hole 23 are engaged with each other, the pressing support portion 20 is fixed to the body portion 1. When the button 6 is pressed, the fixing pin 8 is moved and the engagement of the fixing pin 8 to the pin hole 23 is released and the pressing support portion 20 is detached downward from the body portion 1.

In addition, as shown in FIGS. 18A to 18D, the pressing support portion 20 includes a rotation fulcrum portion 26 at the rear surface. The rotation fulcrum portion 26 is formed on both side surfaces of the pressing support portion 20 and protruded toward the rear surface side. The outer peripheral surface of the rotation fulcrum portion 26 has a circumferential surface. As shown in FIGS. 18A to 18D, the body portion 1 includes a rotation fulcrum receiving portion 14 corresponding to the rotation fulcrum portion 26. The rotation fulcrum receiving portion 14 is a recessed portion formed on both side surfaces of the body portion 1.

Figure 18A:
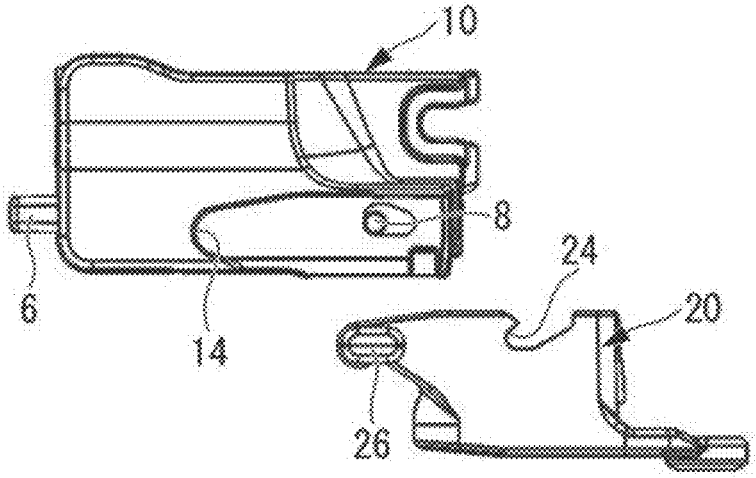
FIGS. 18A to 18D are side views showing the cloth movement detection device of an embodiment of the present invention in a state that a pressing support portion is attached to or detached from the body portion.
Figure 18B:
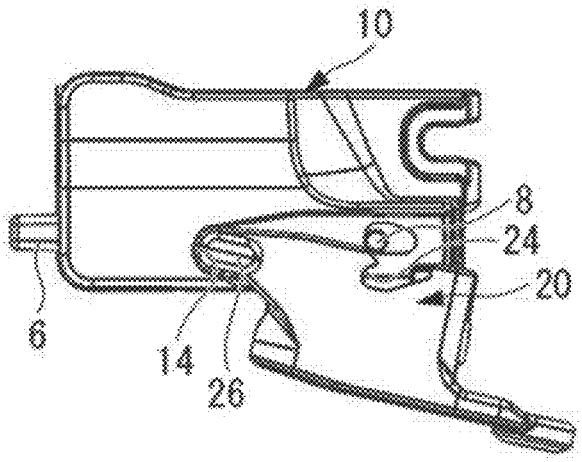
Figure 18C:
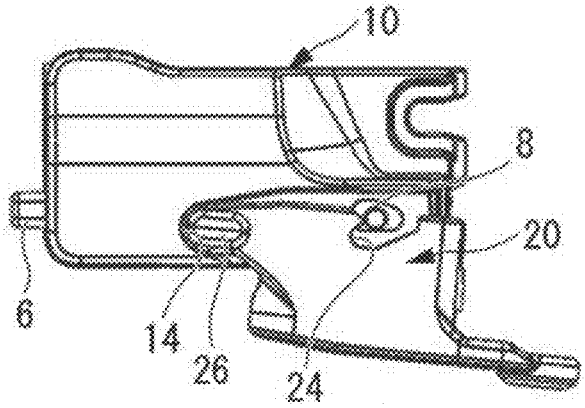
Figure 18D:
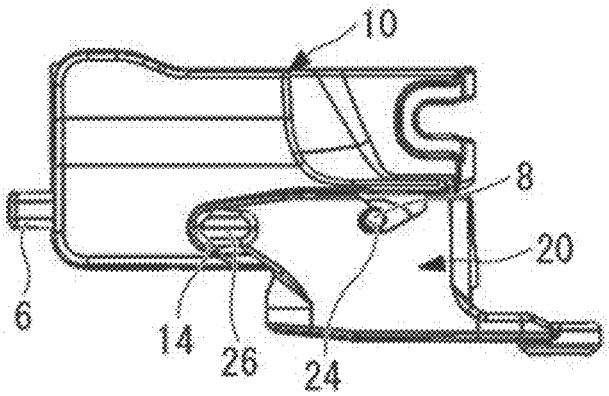

Hereafter, the operation of mounting (attaching) the pressing support portion 20 will be explained. First, from the state where the pressing support portion 20 is detached as shown in FIG. 18A, the rotation fulcrum portion 26 of the pressing support portion 20 is inserted into the rotation fulcrum receiving portion 14 of the body portion 1 as shown in FIG. 18B. After that, as shown in FIG. 18C, the pressing support portion 20 is pressed upward using the rotation fulcrum portion 26 as an axis. Consequently, the fixing pin 8 energized by a spring 13 is guided by the edge of the pressing support portion 20 and retracted to the front side. Then, as shown in FIG. 18D, when the pressing support portion 20 is further pressed upward, the fixing pin 8 is guided into a hook portion 24 formed in an inner surface of the pressing support portion 20, the fixing pin 8 is moved in the pin hole 23 and the fixing pin 8 is engaged with the pin hole 23 of the pressing support portion 20. When the fixing pin 8 and the pin hole 23 are engaged with each other, the pressing support portion 20 is fixed to the body portion 1.

Since the rotation fulcrum portion 26 of the pressing support portion 20 can be inserted into the rotation fulcrum receiving portion 14 of the body portion 1 and the pressing support portion 20 and the body portion 1 can be moved using the rotation fulcrum portion 26 as an axis, the operator can mount the pressing support portion 20 easily and certainly. In addition, since the fixing pin 8 is guided to the edge of the pressing support portion 20 and the hook portion 24 and the fixing pin 8 and the pin hole 23 are engaged with each other, the operator should only press the pressing support portion 20 upward during a mounting operation. Thus, the mounting operation is easy.

Then, the operation of detaching the pressing support portion 20 will be explained. First, from the state where the pressing support portion 20 is attached as shown in FIG. 18D, the button 6 is pressed and the fixing pin 8 is moved to the front surface side of the body portion 1 as shown in FIG. 18C. Consequently, as shown in FIG. 18B, the engagement of the fixing pin 8 to the pin hole 23 is released and the fixing pin 8 is detached from the hook portion 24 provided on the inner surface of the pressing support portion 20. As a result, as shown in FIG. 18A, the pressing support portion 20 is detached downward from the body portion 1 by the weight of the pressing support portion 20.

Since the structure of releasing the engagement of the fixing pin 8 to the pin hole 23 only by pressing the button 6 by the operator is provided on the rear surface of the body portion 1, the operator should only press the button 6 without directly pressing the fixing pin 8. Thus, the detaching operation is easy.

Then, the sensitivity adjustment of the light detection portion 2 will be explained.

In some cases, the moving amount different from the actual moving amount of the cloth may be calculated due to the influence of the material and the color of the cloth and the influence of the sensitivity of the light detection portion 2. In such a case, the moving speed of the needle 53 in the vertical direction may be different from the desired moving speed.

Therefore, the present embodiment includes the function for allowing the operator to perform the sensitivity adjustment of the light detection portion 2. As shown in FIG. 6, the controller 5 includes an input receiving section 33 configured to receive an input related to the adjustment of the sensitivity of the light detection portion 2 and a speed adjustment section 34 configured to adjust the rotation speed of the motor 54 based on the inputted information. The speed adjustment section 34 changes and calculates the rotation speed of the motor based on the information inputted related to the adjustment of the sensitivity. The motor drive controller 32 drives the motor and changes the moving speed of the needle 53 in the vertical direction based on the rotation speed calculated by the speed adjustment section 34.

Figure 23:
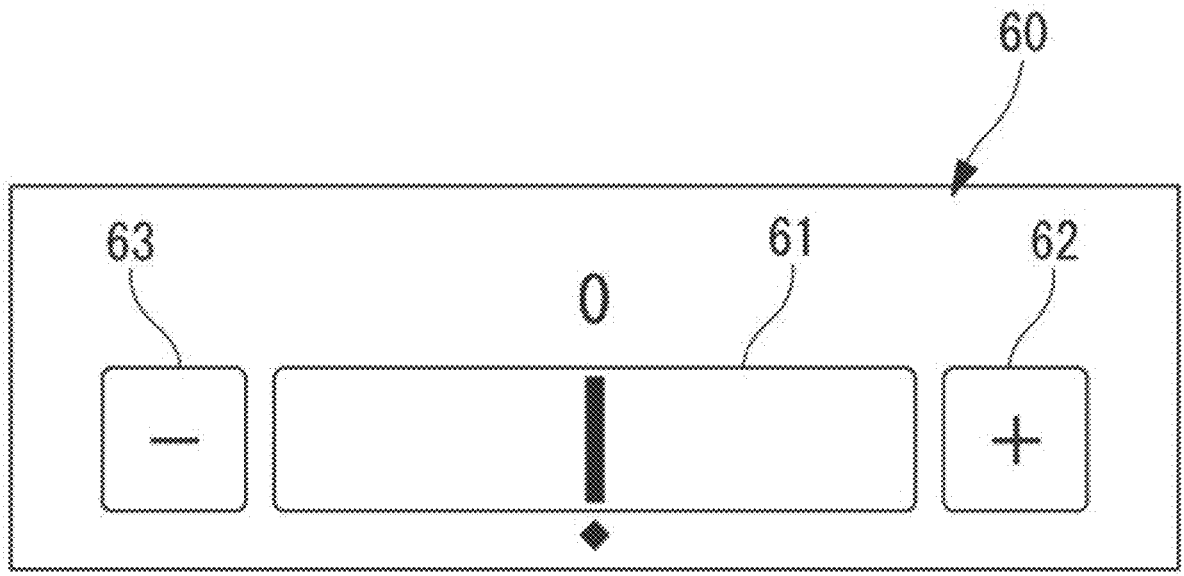
FIG. 23 is a schematic diagram showing a sensitivity adjustment section displayed on a display of the sewing machine of an embodiment of the present invention.

For example, as shown in FIG. 23, a sensitivity adjustment section 60 including a sensitivity adjustment slide bar 61 and buttons 62, 63 is displayed on the display 55 provided on the sewing machine 50. When the input is performed by the button 62 indicating "+," the sensitivity of the light detection portion 2 is increased. When the input is performed by the button 63 indicating "–," the sensitivity of the light detection portion 2 is decreased. Note that the sensitivity adjustment section 60 is not limited to the display 55. An actually slidable knob and bar can be provided on the body of the sewing machine 50.

Figure 21:
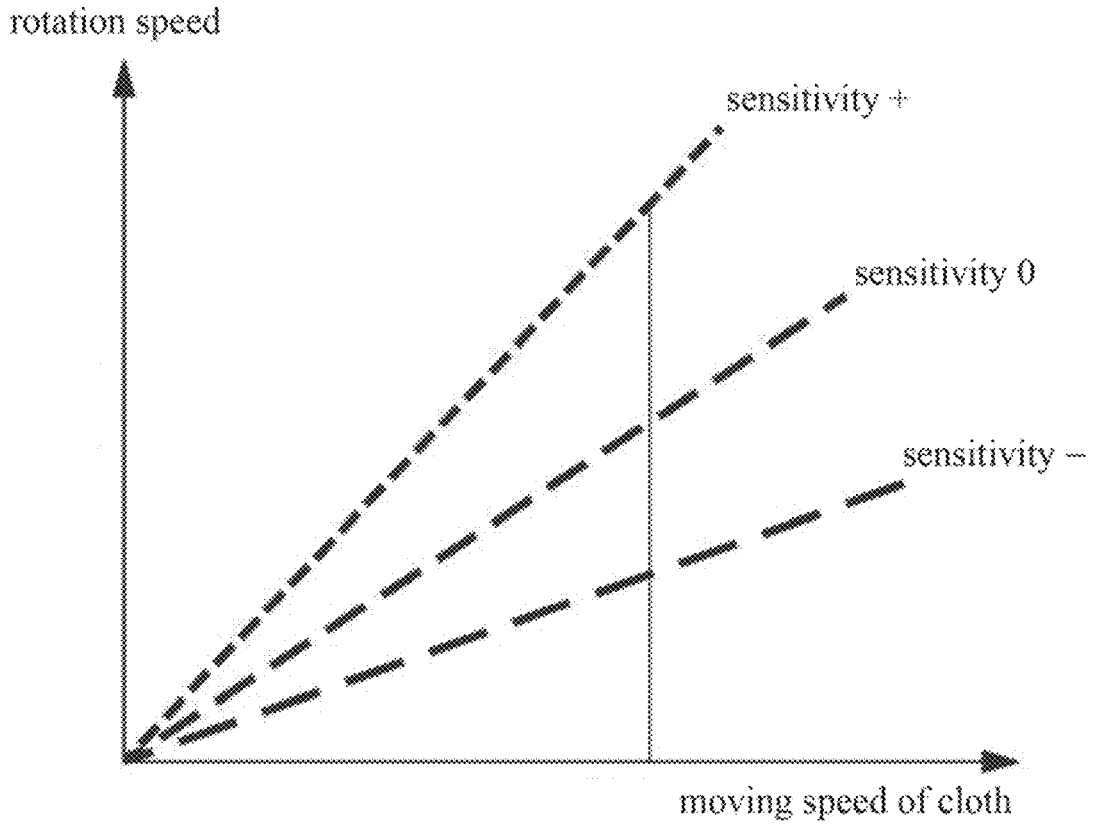
FIG. 21 is a graph showing a relation between a moving speed of the cloth and a rotation speed of the motor.
Figure 22:
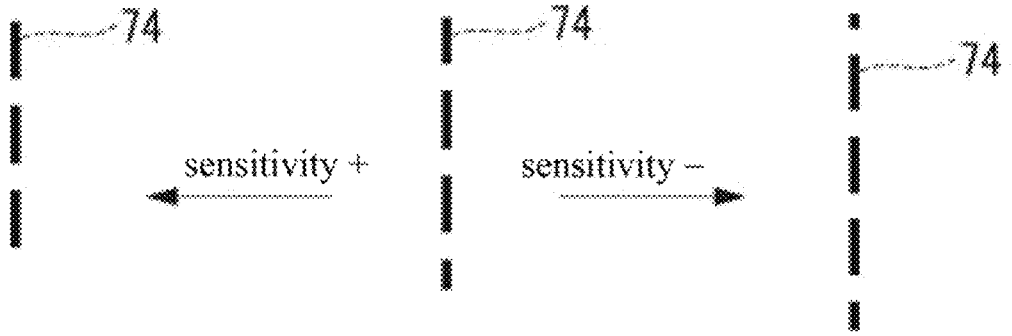
FIG. 22 is an explanation drawing showing a sewn pitch formed by a sensitivity adjustment.

As shown in FIG. 21, when the input is performed in the direction of increasing the sensitivity, the rotation speed of the motor 54 (i.e., the moving speed of the needle 53 in the vertical direction) with respect to the moving amount of the cloth is increased compared to the case where the sensitivity adjustment is not performed. As a result, as shown in FIG. 22, the sewn pitch of the seams 74 is shorter than the case where the sensitivity adjustment is not performed in condition that the moving amount of the cloth is same. During the sewing, when the actually sewn pitch is longer than the specified sewn pitch, it is preferred to perform the input in the direction of increasing the sensitivity.

As shown in FIG. 21, when the input is performed in the direction of decreasing the sensitivity, the rotation speed of the motor 54 (i.e., the moving speed of the needle 53 in the vertical direction) with respect to the moving amount of the cloth is decreased compared to the case where the sensitivity adjustment is not performed. As a result, as shown in FIG. 22, the sewn pitch of the seams 74 is longer than the case where the sensitivity adjustment is not performed in condition that the moving amount of the cloth is same. During the sewing, when the actually sewn pitch is shorter than the specified sewn pitch, it is preferred to perform the input in the direction of decreasing the sensitivity.

As described above, since the sensitivity adjustment function is provided, when the actually sewn pitch is different from the specified sewn pitch, the operator can make the actually sewn pitch closer to the specified sewn pitch by the sensitivity adjustment function. When the actually sewn pitch is different due to the cloth 70 hardly detected by the light detection portion 2 or due to the dispersion of the light detection portion 2, the operator can adjust the sensitivity without changing the settings of the sewn pitch. As a result, the operator can perform the sewing comfortably without feeling sense of incongruity where the actually sewn pitch is different from the specified sewn pitch.

Figure 15A:
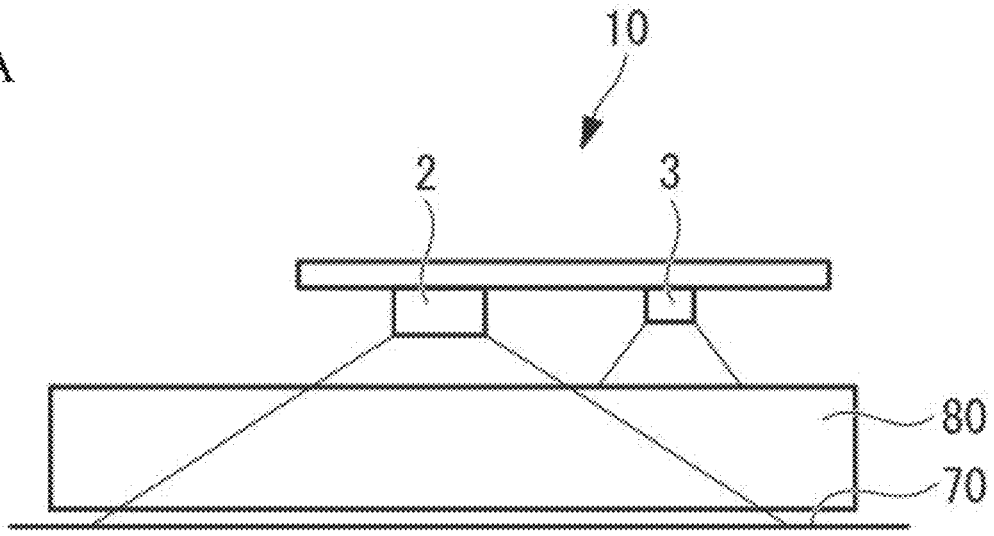
FIG. 15A is a schematic diagram showing a light detection portion and a light irradiation portion of the cloth movement detection device of an embodiment of the present invention.

Then, the positional relation between the light detection portion 2 and the light irradiation portion 3 and the like will be explained with reference to FIGS. 15A and 15B and FIGS. 16A and 16B. When the quilt measuring ruler 80 is used and the distance between the light detection portion 2 and the light irradiation portion 3 is short as shown in FIG. 16A, the light irradiated from the light irradiation portion 3 is reflected on the surface of the quilt measuring ruler 80 in addition to the cloth 70. Thus, a halation area 82 is generated in the detection result of the light detection portion 2 as shown in FIG. 16B. Therefore, as shown in FIG. 15A, the installation position of the light detection portion 2 and the light irradiation portion 3 is determined so that the light irradiated from the light irradiation portion 3 and reflected on the quilt measuring ruler 80 does not enter the light detection portion 2. The light detection portion 2 and the light irradiation portion 3 are installed inside the body portion 1 at the determined position. For example, the positional relation of the light detection portion 2 and the light irradiation portion 3 is determined based on the detectable range of the light detection portion 2, the distance between the light detection portion 2 and the cloth 70 and the irradiation angle of the light irradiation portion 3.

Figure 15B:
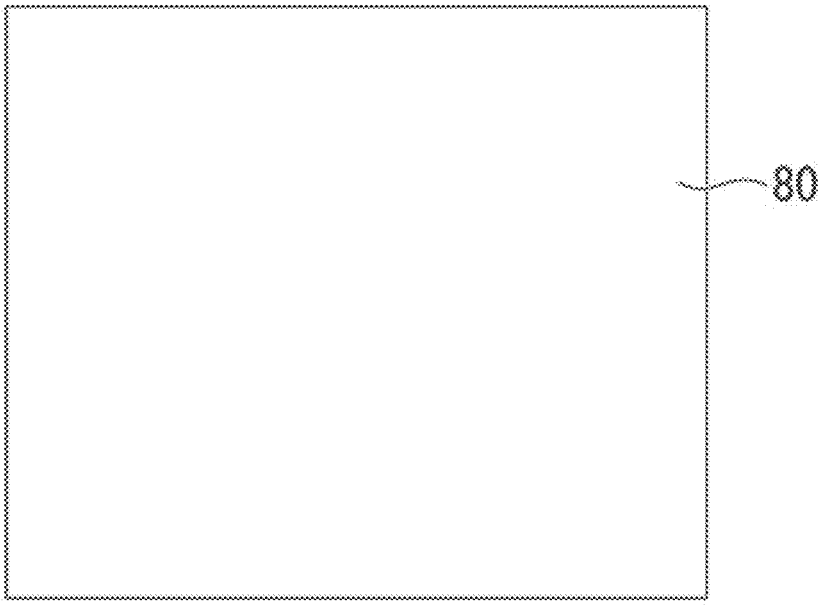
FIG. 15B is a plan view showing a detectable range of the light detection portion.
Figure 16A:
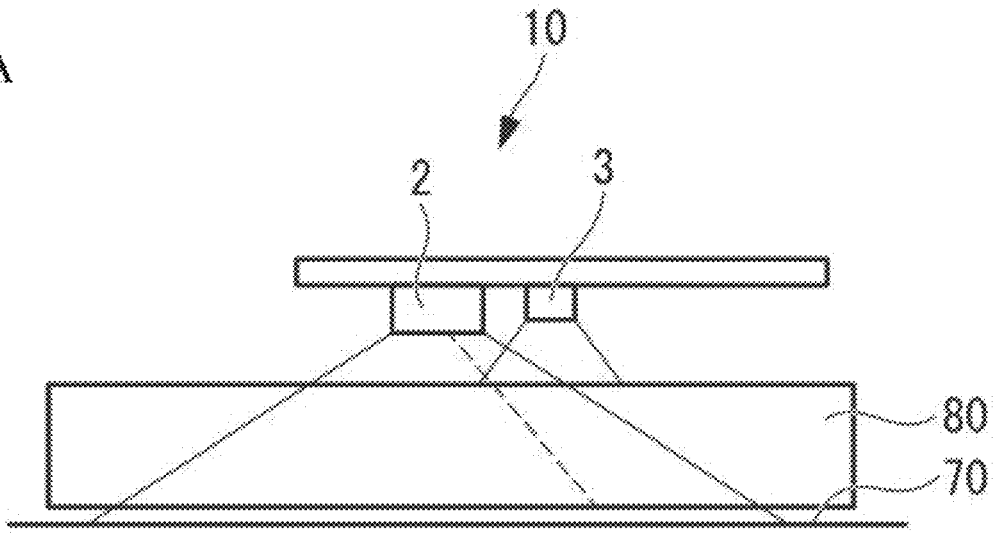
FIG. 16A is a schematic diagram showing a light detection portion and a light irradiation portion of a comparative example.
Figure 16B:
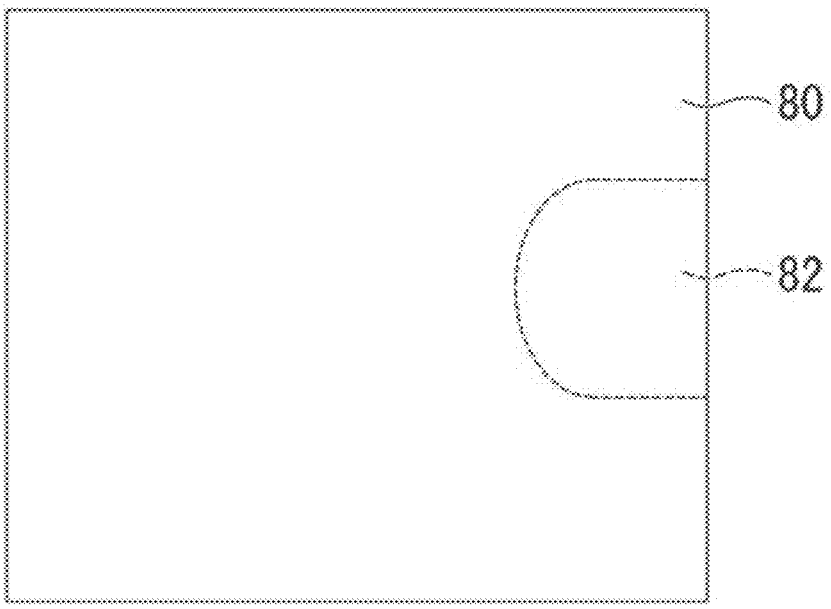
FIG. 16B is a plan view showing a detectable range of the light detection portion.

Consequently, as shown in FIG. 15B, the halation area is not generated in the detection result of the light detection portion 2, and the light detection portion 2 can surely detect the light reflected on the cloth 70 even when the quilt measuring ruler 80 is used.

Then, other application examples of the detection of the cloth movement of the present embodiment will be explained. In the above described embodiment, the example of obtaining the predetermined sewn pitch by controlling the rotation of the motor 54 of the sewing machine (i.e., the moving speed of the needle 53 in the vertical direction) based on the detected moving amount in the case where the cloth 70 is fed by hand. The present invention is not limited to the above described example. The detected moving amount can be also applied to the later described operations of the sewing machine 50, for example.

For example, when an embroidery carriage is attached to the sewing machine 50 and an embroidery frame is moved in two orthogonal directions by a transfer mechanism of the embroidery carriage, the moving amount of the cloth 70 is configured to be detected. The embroidery frame may be moved by the distance different from the predetermined moving distance when the motor 54 steps out due to the overload or other reasons. Therefore, the detected moving amount of the cloth 70 is compared to the predetermined moving distance of the embroidery sewing. When the actual moving amount is judged to be longer or shorter than the predetermined moving distance, the sewing operation of the sewing machine 50 is automatically stopped or the movement of the embroidery carriage is adjusted to adjust the moving distance appropriately. Consequently, the displacement of the sewing can be corrected in the embroidery sewing.

For example, when a feeding mechanism (e.g., feed dog) of the cloth 70 is operated to feed the cloth 70, the moving amount of the cloth 70 is configured to be detected. The cloth 70 may be moved by the amount different from the predetermined amount or the cloth 70 may be stopped when the cloth 70 is caught or due to other reasons. Therefore, the detected moving amount of the cloth 70 is compared to the predetermined amount. When the cloth 70 is judged not to be moved or the cloth 70 is judged to be stopped, the sewing operation of the sewing machine 50 is stopped. Consequently, the sewing defect due to entanglement of the thread caused by continuing the sewing at the same position can be prevented.

In both of the above described application examples, since the position of the bottom surface of the body portion 1 is separated from the cloth 70 compared to the conventional configuration, the detectable range of the light detection portion 2 is widened. As a result, the objects captured in the detectable range are increased. Thus, the characteristic point whose position varies in accordance with the actual movement of the cloth 70 can be easily captured.

Furthermore, the change can be certainly found in the captured image or the characteristic point can be sassily tracked. Thus, the moving amount of the cloth 70 can be correctly calculated.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A cloth movement detection device, comprising:

a light irradiation portion configured to irradiate a cloth with a light;

a light detection portion configured to detect the light for detecting a movement of the cloth;

a body portion configured to be detachably attached to a presser bar of a sewing machine, the light detection portion being installed in the body portion; and a pressing support portion configured to be detachably attached to the body portion, a cloth pressing portion capable of contacting with the cloth being formed on the pressing support portion, wherein a window portion capable of transmitting the light is provided on a bottom surface of the body portion, and the cloth pressing portion is located lower than the bottom surface of the body portion in a state that the pressing support portion is attached to the body portion.

2. The cloth movement detection device according to claim 1, wherein:

the light is an infrared, and the light detection portion is capable of detecting the infrared reflected on the cloth.

3. The cloth movement detection device according to claim 2, wherein a visible light cut filter for shielding a visible light and transmitting the infrared is provided on the window portion.

4. The cloth movement detection device according to claim 1, wherein the light irradiation portion and the light detection portion are installed in the body portion so that the light irradiated by the light irradiation portion and reflected on a surface of a ruler does not enter the light detection portion when the ruler is inserted between the pressing support portion and a needle plate of the sewing machine.

5. The cloth movement detection device according to claim 1, wherein the pressing support portion includes a mounting portion configured to be detachably attached to a side surface of the body portion, a bottom portion of the mounting portion is located on a position separated from the needle plate of the sewing machine, and the cloth pressing portion is provided lower than the bottom portion of the mounting portion.

6. The cloth movement detection device according to claim 1, wherein the pressing support portion includes a mounting portion configured to be detachably attached to a side surface of the body portion, a wall portion extended to a height position of the cloth pressing portion is provided on the mounting portion, and the wall portion has a shape surrounding the window portion.

7. The cloth movement detection device according to claim 1, wherein a display portion configured to be lighted on and off is provided on the body portion, and the display portion is lighted on and off in accordance with an operation state of the sewing machine.

8. The cloth movement detection device according to claim 1, wherein the pressing support portion includes a rotation fulcrum portion provided on both side surfaces of the pressing support portion and protruded toward a back surface of the pressing support portion, and the body portion includes a rotation fulcrum receiving portion corresponding to the rotation fulcrum portion, the rotation fulcrum receiving portion being provided on both side surfaces of the body portion.

9. The cloth movement detection device according to claim 1, wherein the body portion includes a button provided on a back surface of the body portion and a fixing pin protruded from a side surface of the body portion, the fixing pin being capable of interlocking with the button, the pressing support portion includes a pin hole provided on the side surface of the pressing support portion, the pin hole being capable of engaging with the fixing pin, and an engagement of the fixing pin to the pin hole is configured to be released by pressing the button.

10. A sewing machine comprising:

the cloth movement detection device according to claim 1; and a controller configured to control an operation of a motor for moving a needle of the sewing machine based on the movement of the cloth detected by the cloth movement detection device.

11. The sewing machine according to claim 10, wherein the controller includes:

an input receiving section configured to receive an input related to an adjustment of a sensitivity of the light detection portion; and a speed adjustment section configured to adjust a rotation speed of the motor based on an information inputted from the input receiving section.

* * * * *